US010190232B2

(12) United States Patent
Buckalew et al.

(10) Patent No.: US 10,190,232 B2
(45) Date of Patent: Jan. 29, 2019

(54) APPARATUSES AND METHODS FOR MAINTAINING PH IN NICKEL ELECTROPLATING BATHS

(71) Applicant: Lam Research Corporation, Fremont, CA (US)

(72) Inventors: Bryan L. Buckalew, Tualatin, OR (US); Thomas A. Ponnuswamy, Sherwood, OR (US); Ben Foley, Sherwood, OR (US); Steven T. Mayer, Aurora, OR (US)

(73) Assignee: Lam Research Corporation, Fremont, CA (US)

( * ) Notice: Subject to any disclaimer, the term of this patent is extended or adjusted under 35 U.S.C. 154(b) by 998 days.

(21) Appl. No.: 13/960,624

(22) Filed: Aug. 6, 2013

(65) Prior Publication Data

US 2015/0041327 A1 Feb. 12, 2015

(51) Int. Cl.
*C25D 21/04* (2006.01)
*C25D 21/12* (2006.01)
(Continued)

(52) U.S. Cl.
CPC ..... *C25D 21/04* (2013.01); *C25D 3/12* (2013.01); *C25D 17/001* (2013.01);
(Continued)

(58) Field of Classification Search
CPC ..... C25D 21/04
See application file for complete search history.

(56) References Cited

U.S. PATENT DOCUMENTS 4,269,669 A 5/1981 Soby et al.
4,554,056 A 11/1985 Whitford
(Continued)

FOREIGN PATENT DOCUMENTS

CN 101290879 A 10/2008
CN 102242388 A 11/2011
(Continued)

OTHER PUBLICATIONS

U.S. Office Action dated Jun. 15, 2015 issued in U.S. Appl. No. 13/706,296.
(Continued)

*Primary Examiner* — Bryan D. Ripa
(74) *Attorney, Agent, or Firm* — Weaver Austin Villeneuve & Sampson LLP

(57) ABSTRACT

Disclosed herein are electroplating systems for electroplating nickel onto a semiconductor substrate having an electroplating cell for holding an electrolyte solution during electroplating which includes a cathode chamber and an anode chamber configured to hold a nickel anode, and having an oxygen removal device arranged to reduce oxygen concentration in the electrolyte solution as it is flowed to the anode chamber during electroplating and during idle times when the system is not electroplating. Also disclosed herein are methods of electroplating nickel onto a substrate in an electroplating cell having anode and cathode chambers, which include reducing the oxygen concentration in an electrolyte solution, flowing the electrolyte solution into the anode chamber and contacting a nickel anode therein, and electroplating nickel from the electrolyte solution onto a substrate in the cathode chamber, wherein the electrolyte solution in the cathode chamber is maintained at a pH of between about 3.5 and 4.5.

21 Claims, 14 Drawing Sheets

(51) Int. Cl.
*C25D 3/12* (2006.01)
*C25D 17/00* (2006.01)
*C25D 21/14* (2006.01)

(52) U.S. Cl.
CPC ..... *C25D 17/002* (2013.01); *C25D 21/12* (2013.01); *C25D 21/14* (2013.01)

(56) References Cited

U.S. PATENT DOCUMENTS 4,715,938 A 12/1987 Billings
4,726,888 A 2/1988 McCambridge
4,778,572 A 10/1988 Brown
4,832,812 A 5/1989 Brown
4,855,020 A * 8/1989 Sirbola ..... C25D 17/008 204/212
5,997,701 A * 12/1999 Bock ..... C25D 1/10 204/225
6,368,475 B1 * 4/2002 Hanson ..... C25D 5/08 204/252
6,406,611 B1 6/2002 Engelhaupt et al.
6,458,696 B1 * 10/2002 Gross ..... H01L 21/2885 205/131
6,527,920 B1 3/2003 Mayer et al.
6,551,487 B1 4/2003 Reid et al.
6,750,144 B2 * 6/2004 Taylor ..... C25D 5/18 205/101
6,800,187 B1 10/2004 Reid et al.
6,821,407 B1 * 11/2004 Reid ..... C25D 17/12 204/237
8,262,871 B1 9/2012 Mayer et al.
8,308,931 B2 11/2012 Reid et al.
9,359,688 B1 6/2016 Chua et al.
9,732,434 B2 8/2017 Buckalew
2002/0027080 A1 * 3/2002 Yoshioka ..... C25D 17/02 205/123
2003/0066756 A1 * 4/2003 Gabe ..... C25D 3/02 205/296
2003/0178315 A1 9/2003 Taylor
2004/0016647 A1 * 1/2004 Yang ..... A23D 7/00 205/123
2004/0026255 A1 * 2/2004 Kovarsky ..... C25D 21/18 205/99
2005/0230262 A1 10/2005 Chen
2006/0032758 A1 2/2006 Klocke et al.
2006/0144699 A1 7/2006 Klocke
2007/0071999 A1 3/2007 Ito et al.
2009/0246410 A1 10/2009 Cao et al.
2010/0320081 A1 12/2010 Mayer et al.
2010/0320609 A1 12/2010 Mayer et al.
2011/0056840 A1 3/2011 Isono
2012/0064462 A1 3/2012 Willey et al.
2012/0138471 A1 6/2012 Mayer et al.
2012/0175263 A1 * 7/2012 Ganesan ..... C25D 3/38 205/98
2013/0041095 A1 2/2013 Yosifon et al.
2013/0095649 A1 * 4/2013 Cheng ..... C23C 18/1617 438/597
2013/0284604 A1 10/2013 Spurlin et al.
2013/0313123 A1 11/2013 Abraham et al.
2015/0299882 A1 10/2015 Buckalew
2015/0299891 A1 10/2015 Buckalew
2017/0298532 A1 10/2017 Buckalew

FOREIGN PATENT DOCUMENTS

CN 102677139 A 9/2012
CN 102766894 A 11/2012
JP H01-159395 A 6/1989
JP 2005-320631 A 11/2005
JP 2007169700 A 7/2007
TW 200413573 A 8/2004
WO WO01/068952 A1 9/2001

OTHER PUBLICATIONS

U.S. Notice of Allowance dated Feb. 16, 2016 issued in U.S. Appl. No. 13/706,296.
U.S. Office Action dated Feb. 22, 2016 issued in U.S. Appl. No. 14/256,883.
U.S. Appl. No. 13/706,296, filed Dec. 5, 2012, entitled "Apparatuses and Methods for Controlling pH in Electroplating Baths."
U.S. Appl. No. 14/256,872, filed Apr. 18, 2014, entitled "Methods and Apparatuses for Electroplating Nickel Using Sulfur-Free Nickel Anodes."
U.S. Appl. No. 14/256,883, filed Apr. 18, 2014, entitled "Nickel Electroplating Systems Having a Grain Refiner Releasing Device."
U.S. Office Action dated Dec. 22, 2016 issued in U.S. Appl. No. 14/256,872.
Chinese First Office Action dated Apr. 28, 2016 issued in Application No. CN Application No. 201410382721.3.
U.S. Notice of Allowance dated Apr. 12, 2017 issued in U.S. Appl. No. 14/256,872.
Chinese Second Office Action dated Feb. 22, 2017 issued in Application No. CN 201410382721.3.
Chinese Third Office Action dated Feb. 5, 2018 issued in Application No. CN 201410382721.3.
Taiwanese First Office Action dated Jan. 5, 2018 issued in Application No. TW 103126801.
Chinese Fourth Office Action dated Jul. 10, 2018 issued in Application No. CN 201410382721.3.
Taiwanese Second Office Action [Decision of Refusal] dated Jul. 16, 2018 issued in Application No. TW 103126801.
Japanese First Office Action dated Sep. 11, 2018 issued in Application No. JP 2014-158336.

* cited by examiner

APPARATUSES AND METHODS FOR MAINTAINING PH IN NICKEL ELECTROPLATING BATHS

BACKGROUND

Nickel sulfamate baths are a common electrolyte formulation used in many advanced nickel plating applications such as various wafer level packaging (WLP) applications, and various engineering applications where low stress films are a requirement. These baths are typically composed of dissolved nickel sulfamate salts, boric acid, and in some formulations, small amounts of one or more plating additives for changing the deposit surface and stress properties (e.g. saccharin as a film stress reliever and brightener). In some systems, chloride ion is added to help aide and maintain proper dissolution at the nickel anode, particularly when sulfur containing nickel depolarized anode is not used. Typically, the target acidity of these baths is within a pH range broadly of about 3.0 to about 5.0, and sometimes within a more limited range of 3.5 to 4.5.

In a typical nickel electroplating process flow, such as that employed in a typical wafer level packaging (WLP) application, multiple semiconductor wafers are plated sequentially in each nickel sulfamate bath. Since deviations in bath composition can result in inferior electroplating, poor process performance, and potentially defects in the plated nickel layers, ideally, each wafer is plated under substantially the same process conditions, relatively invariant with time and constant over the plating of numerous wafers. In practice, however, maintaining constant process conditions in nickel sulfamate baths can pose a significant challenge.

SUMMARY OF THE DISCLOSURE

Disclosed herein are electroplating systems for electroplating nickel onto a semiconductor substrate. The systems may include an electroplating cell configured to hold an electrolyte solution during electroplating which includes a wafer holder for holding the wafer during electroplating, a cathode chamber, and an anode chamber configured to hold a nickel anode during electroplating, and the systems may also include an oxygen removal device arranged to reduce oxygen concentration in the electrolyte solution as it is flowed to the anode chamber during electroplating and during idle times when the system is not electroplating. In some embodiments, the systems' electroplating cell may further include a porous separator between the anode chamber and the cathode chamber which permits the passage of ionic current during electroplating, but inhibits the passage of electrolyte solution. In some embodiments, the porous separator may be capable of maintaining a difference in oxygen concentration between the anode and cathode chambers, and in some embodiments, the porous separator may be a micro-porous membrane substantially free of ion exchange sites.

In some embodiments, the electrolyte is kept flowing to the anode chamber during some or all idle times when the electroplating system is not electroplating. In some embodiments, the oxygen removal device may be configured to reduce the oxygen concentration in the electrolyte solution flowing to the anode chamber during some or all idle times. In some embodiments, the oxygen removal device may be configured to reduce the oxygen concentration in the electrolyte solution flowing to the anode chamber during some or all idle times to a to a level such that the pH of the of electrolyte solution does not appreciably increase when contacting the nickel anode during idle time. In some embodiments, the oxygen removal device is configured to reduce oxygen concentration in the electrolyte solution to a level of about 1 ppm or less. In some embodiments, the oxygen removal device is configured to reduce oxygen concentration in the electrolyte solution to level of about 0.5 ppm or less. In some embodiments, the system is configured to expose the electrolyte solution to the atmosphere while electroplating nickel onto the substrate.

In some embodiments, the electroplating system may further include a fluidic inlet to the anode chamber, a fluidic outlet from the anode chamber, and an anode chamber recirculation loop coupled to the fluidic inlet and the fluidic outlet, and configured to flow the electrolyte solution through the anode chamber while electroplating nickel onto the substrate. In some embodiments, the electroplating system may further include a bath reservoir located outside the electroplating cell for holding electrolyte solution, the bath reservoir including a fluidic inlet and a fluidic outlet, the fluidic inlet and fluidic outlet coupled to the anode chamber recirculation loop. In some embodiments, the oxygen removal device comprises a degasser located in the anode chamber recirculation loop upstream from the anode chamber and downstream from the bath reservoir.

In some embodiments, the electroplating system may further include a fluidic inlet to the cathode chamber, a fluid outlet from the cathode chamber, and a cathode chamber recirculation loop coupled to the fluidic inlet and fluidic outlet of the cathode chamber and also coupled to the fluidic inlet and fluidic outlet of the bath reservoir, wherein the cathode chamber recirculation loop is configured to flow the electrolyte solution through the cathode chamber while electroplating nickel onto the substrate. In some embodiments, the oxygen removal device may include a degasser located in the anode chamber recirculation loop upstream from the anode chamber and downstream from the bath reservoir, and wherein the degasser is not located in the cathode chamber recirculation loop. In some embodiments, the system may further include a filter located in the anode chamber recirculation loop upstream from the anode chamber and downstream from the oxygen removal device and the bath reservoir, wherein the filter is configured to remove particles from the electrolyte solution. In some embodiments, the oxygen removal device may include a device for sparging the electrolyte solution with a gas substantially free of oxygen.

In some embodiments, the electroplating system may further include a pH meter configured to measure the pH of the electrolyte solution. In some embodiments, the electroplating system may further include logic for operating the oxygen removal device in response to values output by the pH meter. In some embodiments, the electroplating system may further include an oxygen sensor configured to measure the concentration of oxygen in the electrolyte solution.

In some embodiments, the electroplating system may further include a substrate electrical contact configured to supply a voltage bias to the substrate while it is held in the substrate holder, a counterelectrode electrical contact configured to supply a voltage bias to a counterelectrode while contacting the counterelectrode, an acid generating surface configured to generate free hydrogen ions in the electrolyte solution upon supply of sufficient positive voltage bias relative to the counterelectrode electrical contact, and one or more electrical power units configured to supply a negative voltage bias to the substrate electrical contact relative to the counterelectrode electrical contact sufficient to reduce and plate nickel ions from the electrolyte solution onto the substrate surface, and to supply a positive voltage bias to the acid generating surface relative to the counterelectrode electrical contact sufficient to generate free hydrogen ions at the acid generating surface thereby decreasing the pH of the electrolyte solution. In certain such embodiments, free hydrogen ions are generated at the acid generating surface by electrolysis of water molecules in the electrolyte solution. In certain embodiments, the acid generating surface may include a body comprising an electrically-conductive, corrosion-resistant material which does not substantially corrode in the electrolyte solution, and a coating on the body, the coating comprising either platinum or one or more metal oxides selected from the oxides of platinum, niobium, ruthenium, iridium, and tantalum. In some embodiments, the electrically-conductive, corrosion-resistant material is titanium, tantalum, niobium, or zirconium. In some embodiments, the electroplating system may further include an acid generating bath reservoir having a fluidic inlet and a fluidic outlet, the reservoir configured to hold a volume of the electrolyte solution, and within which the acid generating surface is located, and an acid generating bath reservoir recirculation loop fluidically coupling the acid generating bath reservoir's fluidic outlet with the anode chamber's fluidic inlet and/or cathode chamber's fluid inlet, and fluidically coupling the reservoir's fluidic inlet with the anode chamber's fluid outlet and/or cathode chamber's fluid outlet, wherein the counterelectrode electrical contact is further configured to supply a voltage bias to a counterelectrode located within the acid generating bath reservoir, and wherein, during circulation of the electrolyte solution through the acid generating bath reservoir recirculation loop, the electrolyte solution flowing through the reservoir's fluidic outlet has a lower pH than the electrolyte solution flowing through the reservoir's fluidic inlet.

Also disclosed herein are methods of electroplating nickel onto a semiconductor substrate in an electroplating cell having an anode chamber containing a nickel anode, a cathode chamber, and a porous separator between the anode chamber and the cathode chamber permitting passage of ionic current during electroplating but inhibiting the passage of electrolyte solution. In some embodiments, the methods may include reducing the oxygen concentration in an electrolyte solution to about 1 PPM or less, flowing the electrolyte solution having the reduced oxygen concentration into the anode chamber, contacting the electrolyte solution having the reduced oxygen concentration with the nickel anode contained in the anode chamber, and electroplating nickel from the electrolyte solution onto a substrate in the cathode chamber. In certain such embodiments, the electrolyte solution may be maintained in the cathode chamber at a pH of between about 3.5 and 4.5. In some embodiments, the methods may further include flowing the electrolyte solution to the cathode chamber, wherein the oxygen concentration in the electrolyte solution flowed to the anode chamber is less than the oxygen concentration in the electrolyte solution flowed to the cathode chamber. In some embodiments, reducing the oxygen concentration in the electrolyte solution may further include reducing the concentration to about 0.5 PPM or less. In some embodiments, the temperature of the electrolyte solution during electroplating is above about 40 degrees Celsius. In some embodiments, reducing the oxygen concentration in the electrolyte solution comprises degassing the electrolyte solution. In some embodiments, reducing the oxygen concentration in the electrolyte solution comprises sparging the electrolyte solution with a gas substantially free of oxygen. In some embodiments, the substantially oxygen-free gas is an inert gas. In some embodiments, the inert gas comprises nitrogen and/or argon. In some embodiments, the methods may further include sensing the pH of the electrolyte solution in the electroplating cell, and sending an alert if the sensed pH is more than about 4.5. In some embodiments, the methods may further include sensing the pH of the electrolyte solution in the electroplating cell, and further reducing the oxygen concentration in the electrolyte solution prior to flowing it into the anode chamber if the sensed pH is more than about 4.5. In some embodiments, the methods may further include sensing the concentration of oxygen in the electrolyte solution in the anode chamber, and further reducing the oxygen concentration in the electrolyte solution prior to flowing it into the anode chamber if the sensed oxygen concentration is more than about 1 PPM.

Also disclosed herein are methods of preventing the pH of an electrolyte solution from increasing to more than about pH 4.5 while electroplating nickel from the electrolyte solution onto a semiconductor substrate in an electroplating cell having anode and cathode chambers. In some embodiments, the methods may include reducing the oxygen concentration in the electrolyte solution to about 1 PPM or below prior to flowing the electrolyte solution into the anode chamber of the electroplating cell.

DETAILED DESCRIPTION

Figure 1A:
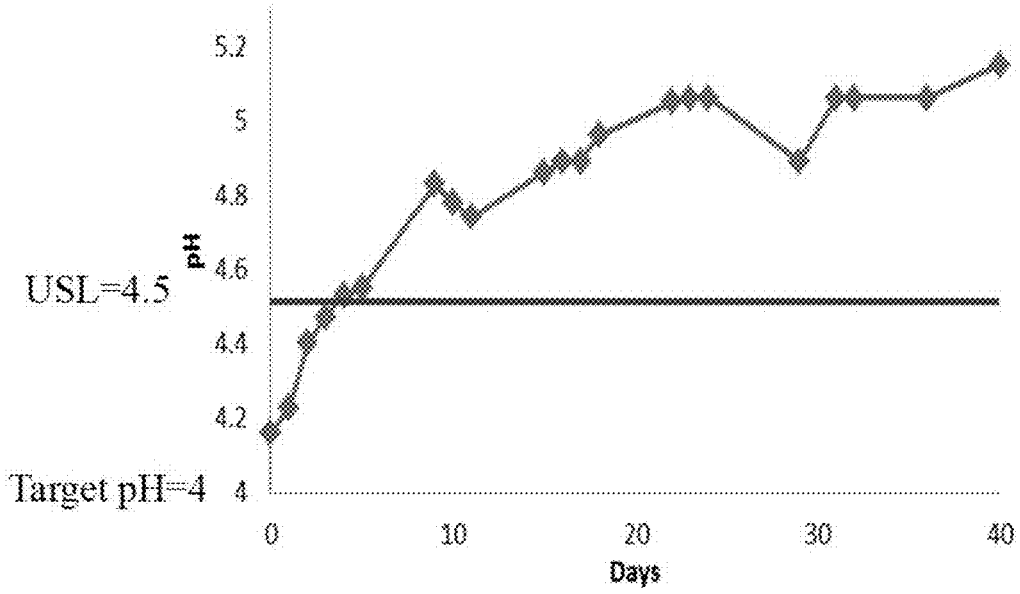
FIG. 1A displays a plot of a nickel sulfamate bath's pH level over the course of 40 days in the absence of any plating operations.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the invention is implemented on a wafer. Oftentimes, semiconductor wafers have a diameter of 200, 300 or 450 mm. However, the invention is not so limited. The work piece may be of various shapes, sizes, and materials. In addition to semiconductor wafers, other work pieces that may take advantage of this invention include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Nickel deposition and electroplating finds various applications in semiconductor fabrication. For instance, electroplated nickel is particularly important in wafer-level packaging (WLP) applications where it finds common use, oftentimes as a material for forming an "under bump diffusion barrier". In such processes, the nickel may be deposited between a "redistribution layer" (often copper) formed on an integrated circuit and a solder ball or "bump". The bump is the solder formed on top of the nickel. Tin silver or tin lead solders are commonly used. The solder may be formed via an electroplating or other process. The nickel is deposited to a thickness of greater than 1 micrometer in certain applications. 2-3 micrometers is commonly used.

However, to ensure consistent and high-quality nickel plating, it is important that the electroplating bath composition and plating process conditions remain substantially constant over the course of sequentially plating many wafers. The maintenance of bath pH level, in particular, within an optimal range, has been found to be of prime importance.

The electrolytic bath solutions used in nickel electroplating operations are oftentimes based upon a nickel-sulfamate chemistry, although other nickel salt chemistries may be used. Such baths are readily available from various commercial sources. These nickel-sulfamate solutions typically have a target pH during electroplating of about 4, with an acceptable operating pH range of between about 3.5 and 4.5. Nickel films deposited using nickel electrolytic bath solutions having pH levels outside of this operating range typically exhibit higher internal stress, oftentimes resulting in the mechanical failure of the nickel films microstructure—obviously unacceptable from an IC fabrication perspective.

Unfortunately, while it might be straightforward to initially adjust the pH level of a nickel-sulfamate bath, it has been found experimentally that the pH levels of these baths tend to drift upward over the course of multiple wafer plating operations, and thus maintaining pH level within an optimal range is problematic. Specifically, pH level tends to drift upwards substantially monotonically, and in some cases proportionally, with the time spent electroplating and/or with the total amount of nickel electroplated—e.g. measured as total charge plated. While not being limited to a particular theory, it is believed that this upward drift in pH during electroplating operations—time when charge is being passed to the wafer—is because the electrochemical reaction which leads to nickel deposition on the wafer is not 100% efficient and that a side reaction occurs concurrently with the may electroplating reaction which tends to consume hydrogen ions in the bath.

It has also been determined by the inventors that nickel sulfamate electroplating baths exhibit a tendency to have their pH levels drift upward even in the absence of ongoing electrochemical plating operations—i.e. during idle periods where there is no electrical charge passed to the wafer. The problem is exemplified in FIG. 1A which plots a nickel sulfamate bath's pH level over the course of 40 days in the absence of any plating operations. Beginning with an initial pH level of slightly less than 4.2, the bath's pH level has exceeded the upper spec limit (USL) of 4.5 in well under 5 days of sitting idle, reaching a pH level of about 5 after 20 days, and still exhibiting a slight upward trend between day 20 and day 40.

Several experiments were also performed in order to attempt to isolate and identify possible contributing factors to idle-time pH drift. As a result, it has been found experimentally that the upward pH drift in nickel-sulfamate baths towards and beyond pH 4.5 during idle time in large measure depends on both the presence of activated nickel anodes and appreciable levels of dissolved oxygen gas in the bath.

Figure 1B:
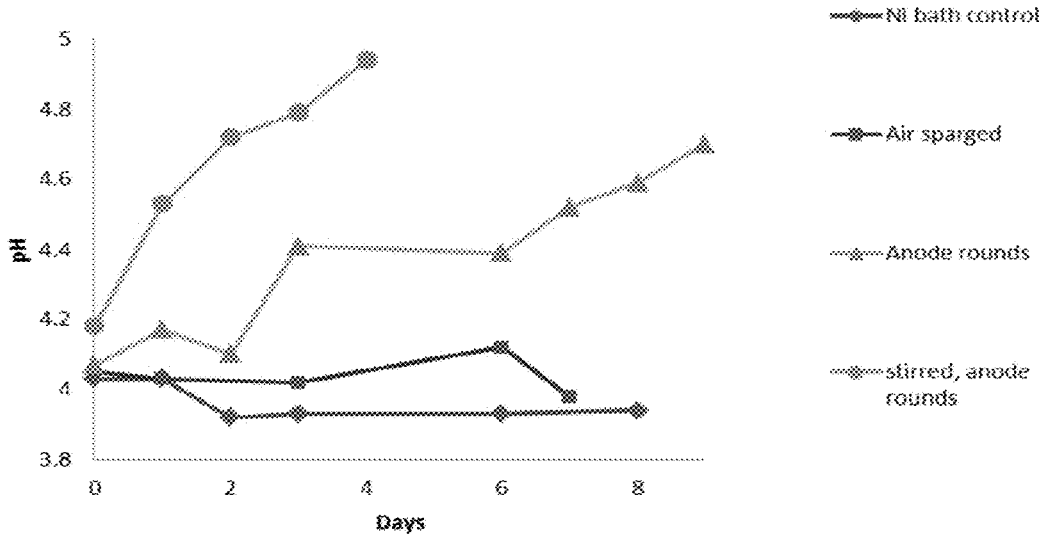
FIG. 1B displays a plot of pH level over the course of several days for several nickel-sulfamate electroplating bath solutions maintained in Erlenmayer flasks at 55 degrees Celsius under 4 different sets of conditions.

To illustrate, FIG. 1B plots pH level over the course of several days for several nickel-sulfamate electroplating bath solutions (Ni200 solutions available from Enthone, Inc., see below) maintained in Erlenmayer flasks at 55 degrees Celsius under 4 different sets of conditions. The lowest plotline corresponds to a Ni bath control solution (as indicated in the legend of the figure) which corresponds to a solution unexposed to nickel anodes (i.e., there were no nickel anodes in the flask). The figure shows that the pH level remained level at approximately 4.0 for the duration of the test. Likewise, for the solution subjected to air sparging, again without the presence of nickel anodes, the pH remained constant at approximately 4.0. However, the two remaining plots in FIG. 1B, which correspond to solutions stored with nickel anodes (see legend) (S-round anodes manufactured by Vale Americas Inc.), show that pH level did drift upwards in the presence of the nickel anodes, to above pH 4.5 after about 7 days in both cases, and much more rapidly when the bath solution was stirred. The conclusion is that nickel anode presence in an electroplating cell is a key factor in the upward pH drift seen during idle periods, and that exposure to air and oxygen gas, by themselves, are not responsible for the drift. The effect of stirring the electroplating solution on the rapidity of the observed pH drift should also be noted. Particularly because, in some electroplating apparatuses, although no charge is passed to the wafer during idle periods (when nickel is not being plated), electrolyte may still be flowed through the apparatus's anode and cathode chambers—due to possible inconvenience associated with stopping the flow of electrolyte when the electroplating system is idle—and such ongoing flow during idle periods may be mimicked (to some extent) by the stifling performed in this particular experiment.

Figure 1C:
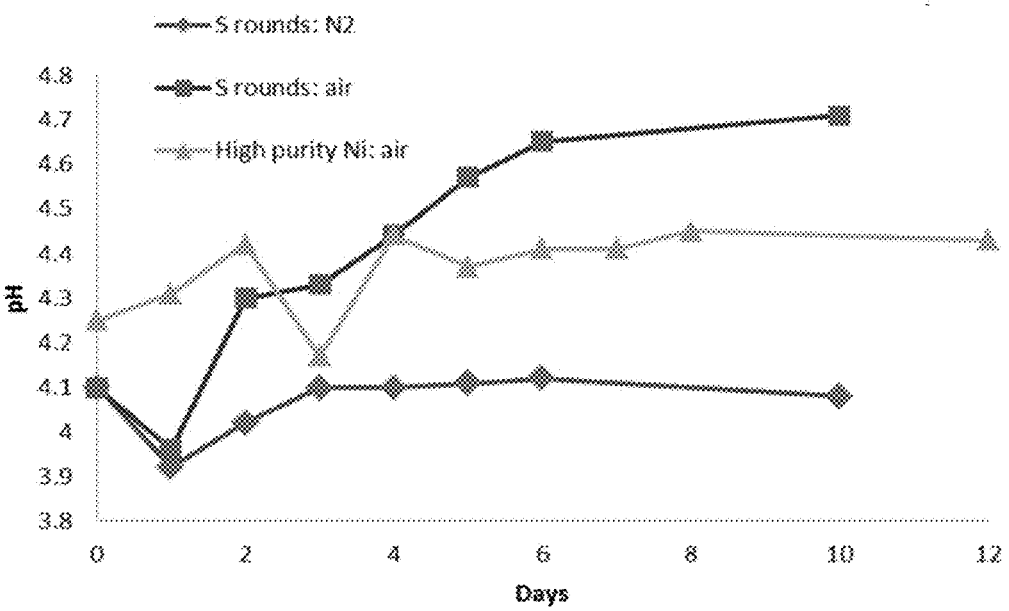
FIG. 1C also displays a plot of pH level over the course of several days for several nickel-sulfamate electroplating bath solutions maintained in Erlenmayer flasks at 55 degrees Celsius under various conditions.

The effect of nickel anode composition and the level of dissolved oxygen on pH drift is shown in FIG. 1C which, once again, plots pH level over the course of several days for several nickel-sulfamate Ni200 electroplating bath solutions maintained in Erlenmayer flasks at 55 degrees Celsius under various conditions. The three plots in the figure (see the legend) correspond to (i) a plating solution exposed to high purity nickel anodes and sparged with air, (ii) a plating solution exposed to sulfur-activated nickel anodes (S-rounds) and sparged with air, and (iii) a plating solution exposed to sulfur-activated nickel anodes (S-rounds) and sparged with nitrogen. Solution (ii) exhibited a pH increase from 4.1 to 4.7 over 10 days, whereas solutions (i) and (iii) exhibited only a subtle pH increase from 4.25 to 4.4. Note that the sulfur-activated nickel anodes (the S-rounds) are enriched with between about 0.022 and 0.30% sulfur which is specifically done in order to prevent oxide formation, and which essentially "activates" the anode—sulfur may be referred to as an anti-passivation additive—thereby improving its dissolution characteristics. The greater pH increase exhibited by the solution exposed to these activated sulfur-containing anodes supports this fact. The conclusion to be drawn as a result of these experiments is that it is the presence of an activated nickel anode in combination with the presence of dissolved oxygen which results in the upward pH drift seen in idle nickel-sulfamate electroplating baths. Since an activated nickel anode is a prerequisite to an efficient nickel electroplating operation, it obviously cannot be eliminated, and so what has been sought as a result of these experiments are methods and apparatuses for minimizing or eliminating dissolved oxygen concentration within the bath in order to mitigate the problem of idle pH drift.

A potential chemical mechanism for the pH drift exhibited by these idle nickel-sulfamate electroplating baths involves oxidation of the nickel anode via the reaction:

$$2Ni+4H^{+}+O_2 \rightarrow 2Ni^{2+}+2H_2O \ [E_0=1.73V] \quad (1).$$

This may be a dominate mechanism for free acid proton consumption leading to the observed pH drift. Oxidation-reduction Reaction (1) is the sum of two half reactions, oxidation of the nickel anode, $$Ni \rightarrow Ni^{2+}+2e^{-} \ [E_0=0.25\ V] \quad (2),$$

And reduction of the dissolved oxygen, $$O_2+4H^{+}+4e^{-} \rightarrow 2H_2O \ [E_0=1.23\ V] \quad (3).$$

Note that the sum of the electrochemical potential shown next to Equation (3) and 2 times the electrochemical potential shown next to Equation (2) is the electrochemical potential of the overall oxidation-reduction reaction shown next to Equation (1) which shows the reaction is thermodynamically favored. In addition, the sulfur in the activated nickel anode lowers the potential at which the nickel will dissolve in the bath, which will increase the thermodynamic driving force shown on the line of Equation (1).

While reactions (1), (2), and (3) are thought to be the dominant mechanism of free acid proton consumption in an idle nickel-sulfamate bath, other mechanisms are also postulated to contribute, either alone or in combination. For example, direct acid induced corrosion (free proton reduction, and nickel oxidation), $$Ni+2H^{+} \rightarrow Ni^{2+}+H_2 \quad (4),$$

may consume free bath protons. Another possible mechanism is related to the fact that nickel anodes initially can have, and most likely will have, one or more oxidized or carbonated layers on their surface. When these oxidized or carbonated layers contact the electrolyte, they are etched off releasing $Ni^{2+}$ and consuming free protons. For instance, the following reactions are likely to occur at the surface of oxidized or carbonated nickel anodes when they contact an acidic electrolyte plating solution:

$$NiO+2H^{+} \rightarrow Ni^{2+}+H_2O \quad (5),$$

$$Ni(CO_3)+H^{+} \rightarrow Ni^{2+}+HCO_3^{-} \quad (6),$$

$$Ni(HCO_3)_2+2H^{+} \rightarrow Ni^{2+}+2H_2CO_3 \quad (7).$$

Moreover, in addition to these pH raising chemical mechanisms which are postulated to occur in idle nickel electroplating baths, additional chemical mechanisms are postulated to contribute towards upward pH drift during times when charge is passed—i.e., during electroplating operations—as mentioned above. Such mechanisms are described in detail in U.S. patent application Ser. No. 13/706,296, filed Dec. 5, 2012, and titled "APPARATUSES AND METHODS FOR CONTROLLING PH IN ELECTROPLATING BATHS," hereby incorporated by reference in its entirety for all purposes. For example, as described therein, it turns out that nickel plating at the working cathode, $$Ni^{2+}(aq)+2e^{-} \rightarrow Ni(s) \quad (8),$$

is not 100% kinetically efficient, and instead is thought to occur with approximately 97-99% efficiency and be accompanied by the consumption of hydrogen ions through hydrogen gas evolution $$2H^{+}+2e^{-} \rightarrow H_2(g) \quad (9),$$

which is thought to account for the remaining 1-3% of acid consumption. Each of these mechanisms involves the net consumption of hydrogen ions, which over time leads to the upward pH drift described above.

Figure 2:
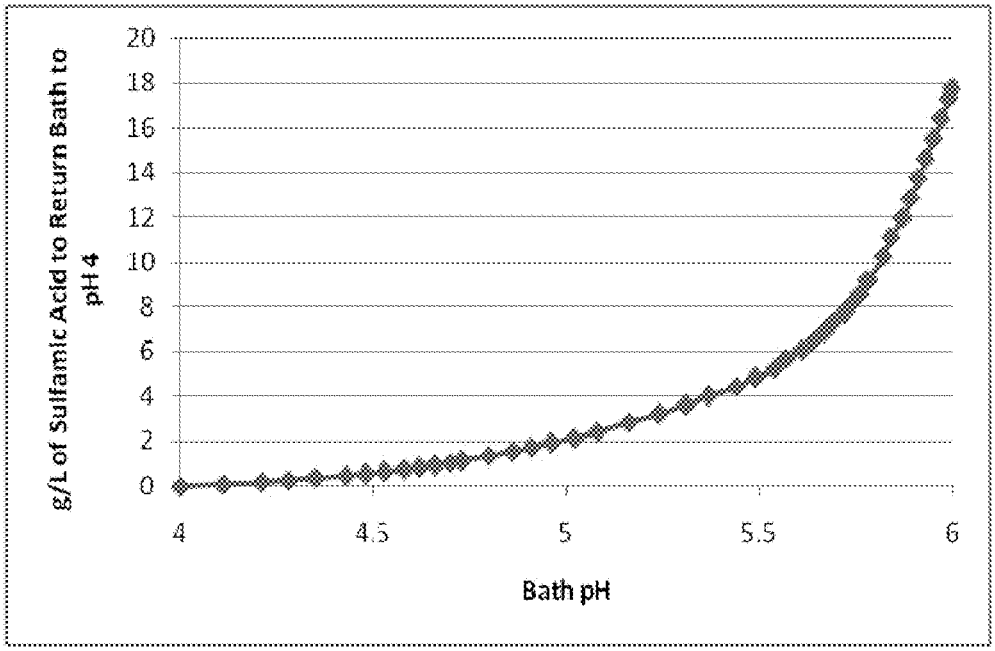
FIG. 2 illustrates the amount of sulfamic acid required to restore a bath having a composition of 75 g/L nickel sulfamate and 30 g/L boric acid from a pH of greater than 4 back to a pH of 4.

One possible method of addressing the consumption of hydrogen ions, is through periodically dosing of the bath with sulfamic acid. FIG. 2 shows the amount of sulfamic acid required to restore a bath having a composition of 75 g/L nickel sulfamate and 30 g/L boric acid from a pH of greater than 4 back to a pH of 4. As seen in FIG. 2, the amount of moderate to strong acid with a pKa less than 4 needed increases considerably the further the solution is from the target pH of 4. Nevertheless, as this figure implies, in principle, it is possible to adjust bath pH, and mitigate its rise, through estimates, calculations, measurements and corrective regular dosing with sulfamic acid.

In practice, however, regular dosing with sulfamic acid poses a plethora of inconveniences, complications, and problems—to a large extent stemming from the short shelf life of sulfamic acid in solution which is due to its hydrolysis over time to form ammonium bisulfate salts:

$$H_3NSO_3+H_2O \rightarrow NH_4^+ + HSO_4^- \quad (10).$$

Because—through Reaction (10)—aqueous sulfamic acid solutions decomposes relatively rapidly, a solution of it typically must be prepared shortly before its use from its solid form. If it is not freshly prepared, and oftentimes even if it is, auto-dosing control presents a formidable predictive challenge because the actual concentration of sulfamic acid in the aqueous solution is constantly decreasing. On the other hand, although solid sulfamic acid is stable and non-hygrosopic, the handling and dosing using solid reagents is undesirable and inconvenient. Either way, however, whether using solid or aqueous forms of sulfamic acid, repeated dosing to mitigate pH drift is going to result in an increase in sulfamate anion concentration beyond the preferred range for the plating bath, and eventually necessitate partial or full replacement of the bath such as by employing a bleed and feed scheme, or the like. Thus, for all of these reasons, from a practical standpoint dosing with sulfamic acid to control pH drift is very problematic and inconvenient at best.

Accordingly, due to the importance of maintaining nickel electroplating bath pH levels within certain preferred pH ranges, methods and apparatuses have been developed to mitigate, and/or reduce, and/or minimize, and/or prevent the pH drift caused by the presence of dissolved oxygen in the bath, and these methods and apparatuses are disclosed herein. In some implementations, the preferred pH range may be between about pH 3.0 and pH 5.0, or more particularly between about pH 3.5 and pH 4.5, or yet more particularly between about pH 3.8 and pH 4.2. These methods and apparatuses typically operate by removing dissolved oxygen gas from the electroplating solution prior to its entry into the anode chambers.

Furthermore, these methods for preventing or reducing pH drift may be implemented within the context of a method for electroplating one or more semiconductor substrates. Likewise, these apparatuses for preventing or reducing pH drift may be implemented within the context of a system and/or apparatus for electroplating one or more semiconductor substrates. Thus, various electroplating systems and apparatuses, methods and operations, etc. are now described in the context of FIGS. 3A-D.

In some embodiments, an electroplating apparatus and related methods may include devices and methods for control of electrolyte hydrodynamics during plating so that highly uniform plating layers are obtained. In specific implementations, the disclosed embodiments employ methods and apparatus that create combinations of impinging flow (flow directed at or perpendicular to the work piece surface) and shear flow (sometimes referred to as "cross flow" or flow with velocity parallel to the work piece surface).

Thus, for instance, one embodiment is an electroplating apparatus including the following features: (a) a plating chamber configured to contain an electrolyte and an anode while electroplating metal onto a substantially planar substrate; (b) a substrate holder configured to hold the substantially planar substrate such that a plating face of the substrate is separated from the anode during electroplating; (c) a channeled ionically resistive element or plate (sometimes referred to herein as a CIRP or flow shaping plate) including a substrate-facing surface that is substantially parallel to and separated from a plating face of the substrate during electroplating, the channeled ionically resistive element including a plurality of non-communicating channels, where the non-communicating channels allow for transport of the electrolyte through the element during electroplating; and (d) a mechanism for creating and/or applying a shearing force (cross flow) to the electrolyte flowing at the plating face of the substrate. Though the wafer is substantially planar, it also typically has one or more microscopic trenches and may have one or more portions of the surface masked from electrolyte exposure. In various embodiments, the apparatus also includes a mechanism for rotating the substrate and/or the channeled ionically resistive element while flowing electrolyte in the electroplating cell in the direction of the substrate plating face.

In certain implementations, the mechanism for applying cross flow is an inlet with, for example, appropriate flow directing and distributing means on or proximate to the periphery of the channeled ionically resistive element. The inlet directs cross flowing catholyte along the substrate-facing surface of the channeled ionically resistive element. The inlet is azimuthally asymmetric, partially following the circumference of the channeled ionically resistive element, and having one or more gaps, and defining a cross flow injection manifold between the channeled ionically resistive element and the substantially planar substrate during electroplating. Other elements are optionally provided for working in concert with the cross flow injection manifold. These may include a cross flow injection flow distribution showerhead and a cross flow confinement ring or flow diverter, which are further described below in conjunction with the figures.

In certain embodiments, the apparatus is configured to enable flow of electrolyte in the direction towards or perpendicular to a substrate plating face to produce an average flow velocity of at least about 3 cm/s (e.g., at least about 5 cm/s or at least about 10 cm/s) exiting the holes of the channeled ionically resistive element during electroplating. In certain embodiments, the apparatus is configured to operate under conditions that produce an average transverse electrolyte velocity of about 3 cm/sec or greater (e.g., about 5 cm/s or greater, about 10 cm/s or greater, about 15 cm/s or greater, or about 20 cm/s or greater) across the center point of the plating face of the substrate. These flow rates (i.e., the flow rate exiting the holes of the ionically resistive element and the flow rate across the plating face of the substrate) are in certain embodiments appropriate in an electroplating cell employing an overall electrolyte flow rate of about 20 L/min and an approximately 12 inch diameter substrate. The embodiments herein may be practiced with various substrate sizes. In some cases, the substrate has a diameter of about 200 mm, about 300 mm, or about 450 mm. Further, the embodiments herein may be practiced at a wide variety of overall flow rates. In certain implementations, the overall electrolyte flow rate is between about 1-60 L/min, between about 6-60 L/min, between about 5-25 L/min, or between about 15-25 L/min. The flow rates achieved during plating may be limited by certain hardware constraints, such as the size and capacity of the pump being used. One of skill in the art would understand that the flow rates cited herein may be higher when the disclosed techniques are practiced with larger pumps.

Note, that in some embodiments, the electroplating apparatus contains separated anode and cathode chambers in which there are different electrolyte compositions, electrolyte circulation loops, and/or hydrodynamics in each of two chambers. An ionically permeable membrane may be employed to inhibit direct convective transport (movement of mass by flow) of one or more components between the chambers and maintain a desired separation between the chambers. The membrane may block bulk electrolyte flow and exclude transport of certain species such as organic additives while permitting transport of ions such as cations. In some embodiments, the membrane contains DuPont's NAFION™ or a related ionically selective polymer. In other cases, the membrane does not include an ion exchange material, and instead includes a micro-porous material. Conventionally, the electrolyte in the cathode chamber is referred to as "catholyte" and the electrolyte in the anode chamber is referred to as "anolyte." Frequently, the anolyte and catholyte have different compositions, with the anolyte containing little or no plating additives (e.g., accelerator, suppressor, and/or leveler) and the catholyte containing significant concentrations of such additives. The concentration of metal ions and acids also often differs between the two chambers. An example of an electroplating apparatus containing a separated anode chamber is described in U.S. Pat. No. 6,527,920, filed Nov. 3, 2000; U.S. Pat. No. 6,821,407, filed Aug. 27, 2002, and U.S. Pat. No. 8,262,871, filed Dec. 17, 2009 each of which is incorporated herein by reference in its entirety.

In some embodiments, the anode membrane need not include an ion exchange material. In some examples, the membrane is made from a micro-porous material such as polyethersulfone manufactured by Koch Membrane of Wilmington, Mass. This membrane type is most notably applicable for inert anode applications such as tin-silver plating and gold plating, but may also be used for soluble anode applications such as nickel plating.

In certain embodiments, and as described more fully elsewhere herein, catholyte is injected into a manifold region, in which electrolyte is fed, accumulates, and then is distributed and passes substantially uniformly through the various non-communication channels of the CIRP directly towards the wafer surface.

In the following discussion, when referring to top and bottom features (or similar terms such as upper and lower features, etc.) or elements of the disclosed embodiments, the terms top and bottom are simply used for convenience and represent only a single frame of reference or implementation of the invention. Other configurations are possible, such as those in which the top and bottom components are reversed with respect to gravity and/or the top and bottom components become the left and right or right and left components.

While some aspects described herein may be employed in various types of plating apparatus, for simplicity and clarity, most of the examples will concern wafer-face-down, "fountain" plating apparatus. In such apparatus, the work piece to plated (typically a semiconductor wafer in the examples presented herein) generally has a substantially horizontal orientation (which may in some cases vary by a few degrees from true horizontal for some part of, or during the entire plating process) and may be powered to rotate during plating, yielding a generally vertically upward electrolyte convection pattern. Integration of the impinging flow mass from the center to the edge of the wafer, as well as the inherent higher angular velocity of a rotating wafer at its edge relative to its center, creates a radially increasing sheering (wafer parallel) flow velocity. One example of a member of the fountain plating class of cells/apparatus is the Sabre® Electroplating System produced by and available from Novellus Systems, Inc. of San Jose, Calif. Additionally, fountain electroplating systems are described in, e.g., U.S. Pat. No. 6,800,187, filed Aug. 10, 2001 and U.S. Pat. No. 8,308,931, filed Nov. 7, 2008, which are incorporated herein by reference in their entireties.

The substrate to be plated is generally planar or substantially planar. As used herein, a substrate having features such as trenches, vias, photoresist patterns and the like is considered to be substantially planar. Often these features are on the microscopic scale, though this is not necessarily always the case. In many embodiments, one or more portions of the surface of the substrate may be masked from exposure to the electrolyte.

Figure 3A:
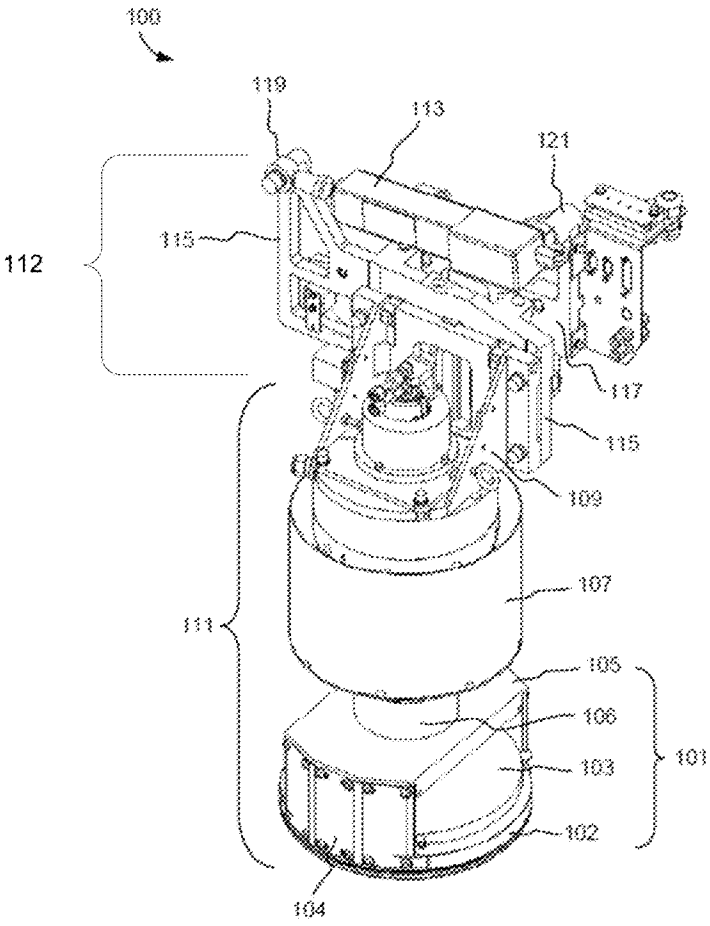
FIG. 3A provides a perspective view of a wafer holding and positioning apparatus for electrochemically treating semiconductor wafers.
Figure 3B:
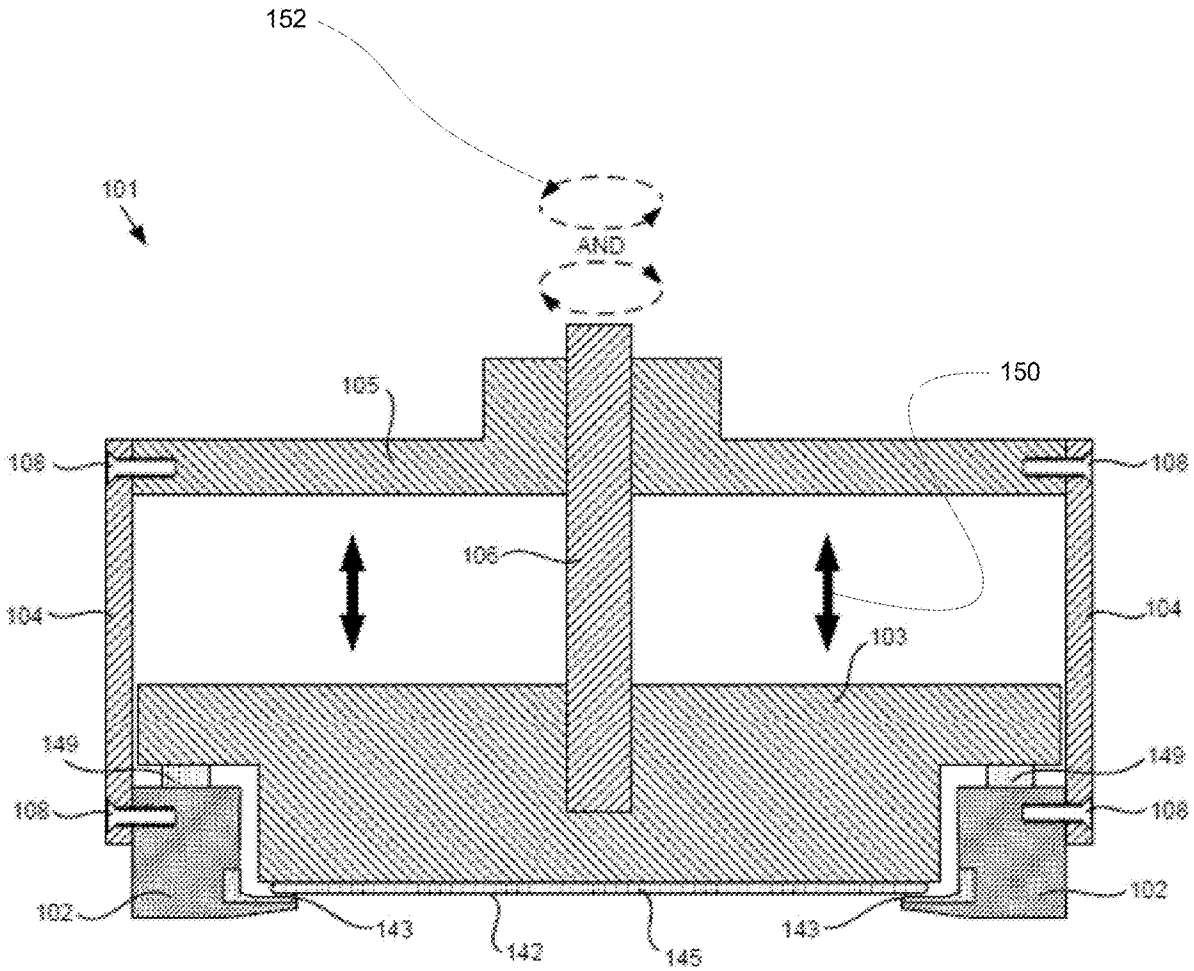
FIG. 3B depicts a wafer holding and positioning apparatus including details of the cone and cup in cross-section format.

The following description of FIGS. 3A and 3B provides a general non-limiting context to assist in understanding the apparatus and methods described herein. FIG. 3A provides a perspective view of a wafer holding and positioning apparatus 100 for electrochemically treating semiconductor wafers. Apparatus 100 includes wafer engaging components (sometimes referred to herein as "clamshell" components). The actual clamshell includes a cup 102 and a cone 103 that enables pressure to be applied between the wafer and the seal, thereby securing the wafer in the cup.

Cup 102 is supported by struts 104, which are connected to a top plate 105. This assembly (102-105), collectively assembly 101, is driven by a motor 107, via a spindle 106. Motor 107 is attached to a mounting bracket 109. Spindle 106 transmits torque to a wafer (not shown in this figure) to allow rotation during plating. An air cylinder (not shown) within spindle 106 also provides vertical force between the cup and cone 103 to create a seal between the wafer and a sealing member (lipseal) housed within the cup. For the purposes of this discussion, the assembly including components 102-109 is collectively referred to as a wafer holder 111. Note however, that the concept of a "wafer holder" extends generally to various combinations and sub-combinations of components that engage a wafer and allow its movement and positioning.

A tilting assembly including a first plate 115, that is slidably connected to a second plate 117, is connected to mounting bracket 109. A drive cylinder 113 is connected both to plate 115 and plate 117 at pivot joints 119 and 121, respectively. Thus, drive cylinder 113 provides force for sliding plate 115 (and thus wafer holder 111) across plate 117. The distal end of wafer holder 111 (i.e. mounting bracket 109) is moved along an arced path (not shown) which defines the contact region between plates 115 and 117, and thus the proximal end of wafer holder 111 (i.e. cup and cone assembly) is tilted upon a virtual pivot. This allows for angled entry of a wafer into a plating bath.

The entire apparatus 100 is lifted vertically either up or down to immerse the proximal end of wafer holder 111 into a plating solution via another actuator (not shown). Thus, a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. Pat. No. 6,551,487 filed May 31, 2001 and issued Apr. 22, 2003, which is herein incorporated by reference in its entirety.

Note that apparatus 100 is typically used with a particular plating cell having a plating chamber which houses an anode (e.g., a nickel anode or a non-metal inert anode) and electrolyte. The plating cell may also include plumbing or plumbing connections for circulating electrolyte through the plating cell—and against the work piece being plated. It may also include membranes or other separators designed to maintain different electrolyte chemistries in an anode compartment and a cathode compartment. In one embodiment, one membrane is employed to define an anode chamber, which contains electrolyte that is substantially free of suppressors, accelerators, or other organic plating additives, or in another embodiment, where the inorganic plating composition of the anolyte and catholyte are substantially different. A mechanism for transferring anolyte to the catholyte or to the main plating bath (e.g. direct pumping including values, or an overflow trough) may optionally also be supplied.

The following description provides more detail of the cup and cone assembly of the clamshell. FIG. 3B depicts a portion, 101, of assembly 100, including cone 103 and cup 102 in cross-section format. Note that this figure is not meant to be a true depiction of a cup and cone product assembly, but rather a stylized depiction for discussion purposes. Cup 102 is supported by top plate 105 via struts 104, which are attached via screws 108. Generally, cup 102 provides a support upon which wafer 145 rests. It includes an opening through which electrolyte from a plating cell can contact the wafer. Note that wafer 145 has a front side 142, which is where plating occurs. The periphery of wafer 145 rests on the cup 102. The cone 103 presses down on the back side of the wafer to hold it in place during plating.

To load a wafer into 101, cone 103 is lifted from its depicted position via spindle 106 until cone 103 touches top plate 105. From this position, a gap is created between the cup and the cone into which wafer 145 can be inserted, and thus loaded into the cup. Then cone 103 is lowered to engage the wafer against the periphery of cup 102 as depicted, and mate to a set of electrical contacts (not shown in 1B) radially beyond the lip seal 143 along the wafer's outer periphery.

Spindle 106 transmits both vertical force for causing cone 103 to engage a wafer 145 and torque for rotating assembly 101. These transmitted forces are indicated by the arrows in FIG. 3B. Note that wafer plating typically occurs while the wafer is rotating (as indicated by the dashed arrows at the top of FIG. 3B).

Cup 102 has a compressible lip seal 143, which forms a fluid-tight seal when cone 103 engages wafer 145. The vertical force from the cone and wafer compresses lip seal 143 to form the fluid tight seal. The lip seal prevents electrolyte from contacting the backside of wafer 145 (where it could introduce contaminating species such as nickel ions directly into silicon) and from contacting sensitive components of apparatus 101. There may also be seals located between the interface of the cup and the wafer which form fluid-tight seals to further protect the backside of wafer 145 (not shown).

Cone 103 also includes a seal 149. As shown, seal 149 is located near the edge of cone 103 and an upper region of the cup when engaged. This also protects the backside of wafer 145 from any electrolyte that might enter the clamshell from above the cup. Seal 149 may be affixed to the cone or the cup, and may be a single seal or a multi-component seal.

Upon initiation of plating, cone 103 is raised above cup 102 and wafer 145 is introduced to assembly 102. When the wafer is initially introduced into cup 102—typically by a robot arm—its front side, 142, rests lightly on lip seal 143. During plating the assembly 101 rotates in order to aid in achieving uniform plating. In subsequent figures, assembly 101 is depicted in a more simplistic format and in relation to components for controlling the hydrodynamics of electrolyte at the wafer plating surface 142 during plating. Thus, an overview of mass transfer and fluid shear at the work piece follows.

Figure 3C:
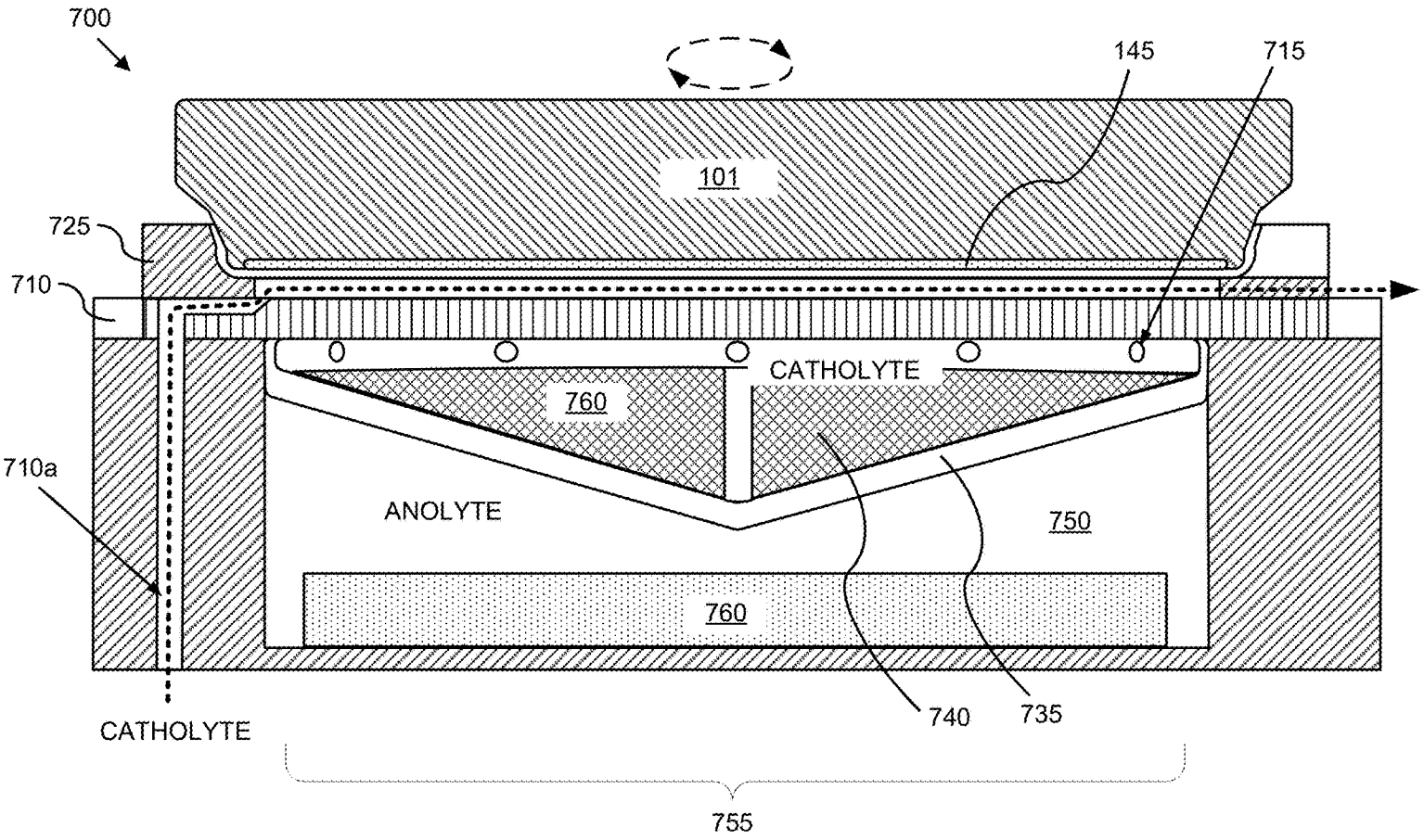
FIG. 3C schematically illustrates an implementation of an electroplating cell having an anode chamber and a cathode chamber in accordance with certain embodiments described herein.

FIG. 3C schematically illustrates an implementation of an electroplating cell having an anode chamber and a cathode chamber in accordance with certain embodiments described herein. Note that the embodiment shown in FIG. 3C, implements certain techniques that may be used to encourage cross flow across the face of a substrate being plated as described in U.S. patent application Ser. No. 13/893,242, filed May 13, 2013, and titled "CROSS FLOW MANIFOLD FOR ELECTROPLATING APPARATUS" hereby incorporated by reference in its entirely and for all purposes. As described more fully in this prior application, in some embodiments, electrolyte flow ports are configured to aid transverse flow, alone or in combination with a flow shaping plate, a cross-flow manifold, and/or a flow diverter as described therein.

For example, the electroplating cell schematically illustrated in FIG. 3C, includes electrolyte inlet flow ports configured for transverse flow enhancement in conjunction with flow shaping plate and flow diverter assemblies. Specifically, FIG. 3C depicts a cross-section of components of a plating apparatus, 700, for plating nickel onto a wafer, 145, which is held, positioned and rotated by wafer holder 101. Apparatus 700 includes a electroplating cell 755 which is a dual chamber cell, having an anode chamber 750 with an anode 760 and anolyte, and a cathode chamber 760. The anode chamber 750 and cathode chamber 760 are separated by a cationic membrane 740 which is supported by a support member 735. Electroplating apparatus 700 includes a flow shaping plate, 710, as described herein. A flow diverter (sometimes called a confinement ring), 725, is on top of flow shaping plate 710, and aides in creating transverse shear flow as described herein. Catholyte is introduced into the cathode chamber (above membrane 740) via flow ports 715. From flow ports 715, catholyte passes through flow plate 710 as described herein and produces impinging flow onto the plating surface of wafer 145. In addition to catholyte flow ports 715, an additional flow port, 710*a*, introduces catholyte at its exit at a position distal to the vent or gap of flow diverter 725. In this example, flow port 710*a*'s exit is formed as a channel in flow shaping plate 710. The functional result is that catholyte flow is introduced directly into the pseudo chamber formed between the flow plate and the wafer plating surface in order to enhance transverse flow across the wafer surface and thereby normalize the flow vectors across the wafer (and flow plate 710).

Figure 3D:
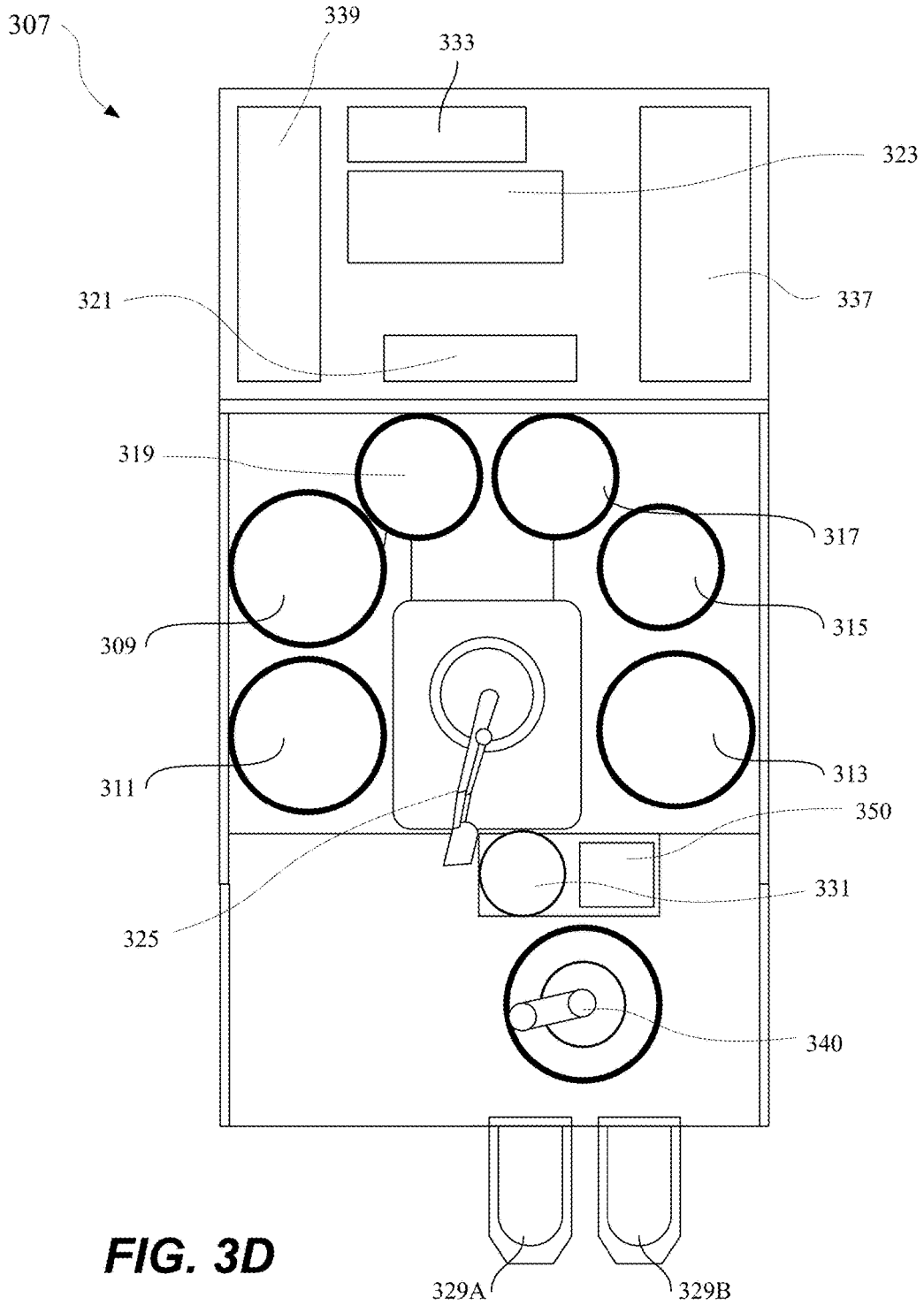
FIG. 3D schematically illustrates an electroplating system which includes three separate electroplating modules, and three separate post-electrofill modules.

Electroplating cells may be included as one or more modules of an electroplating system, which may also benefit from the methods and apparatus disclosed herein for reducing or preventing pH drift. For example, FIG. 3D schematically illustrates an electroplating system 307 which may include multiple electroplating modules, in this case the three separate modules 309, 311, and 313. As described more fully below, each electroplating module typically includes a cell for containing an anode and an electroplating solution during electroplating, and a wafer holder for holding the wafer in the electroplating solution and rotating the wafer during electroplating. The electroplating system 307 shown in FIG. 3D further includes three separate post-electrofill modules (PEMs) 315, 317 and 319. Depending on the embodiment, each of these may be employed to perform any of the following functions: edge bevel removal (EBR), backside etching, and acid cleaning of wafers after they have been electrofilled by one of modules 309, 311, and 313. Note that a post-electrofill module (PEM) which performs edge bevel removal (EBR) will alternatively be referred to herein simply as an EBR module. Electroplating system 307 may also include a chemical dilution module 321 and a central electrofill bath 323. The latter may be a tank that holds the chemical solution used as the electroplating bath in the electrofill modules. Electroplating system 307 may also include a dosing system 333 that stores and delivers chemical additives for the plating bath. If present, the chemical dilution module 321 may store and mix chemicals to be used as the etchant in the post electrofill modules. In some embodiments, a filtration and pumping unit 337 filters the plating solution for central bath 323 and pumps it to the electrofill modules.

Finally, in some embodiments, an electronics unit 339 may serve as a system controller providing the electronic and interface controls required to operate electroplating system 307. The system controller typically includes one or more memory devices and one or more processors configured to execute instructions so that the electroplating system can perform its intended process operations. Machine-readable media containing instructions for controlling process operations in accordance with the implementations described herein may be coupled to the system controller. Unit 339 may also provide a power supply for the system.

In operation, a robot including a back-end robot arm 325 may be used to select wafers from a wafer cassette, such as a cassette 329A or 329B. Back-end robot arm 325 may attach to the wafer using a vacuum attachment or some other feasible attaching mechanism.

A front-end robot arm 340 may select a wafer from a wafer cassette such as the cassette 329A or the cassette 329B. The cassettes 329A or 329B may be front opening unified pods (FOUPs). A FOUP is an enclosure designed to hold wafers securely and safely in a controlled environment and to allow the wafers to be removed for processing or measurement by tools equipped with appropriate load ports and robotic handling systems. The front-end robot arm 340 may hold the wafer using a vacuum attachment or some other attaching mechanism. The front-end robot arm 340 may interface with the cassettes 329A or 329B, a transfer station 350, or an aligner 331. From the transfer station 350, back-end robot arm 325 may gain access to the wafer. The transfer station 350 may be a slot or a position to and from which front-end robot arm 340 and back-end robot arm 325 may pass wafers without going through the aligner 331. In some implementations, however, to ensure that a wafer is properly aligned on the back-end-robot 325 for precision delivery to an electroplating module, the back-end robot arm 325 may align the wafer with aligner 331. Back-end robot arm 325 may also deliver a wafer to one of the electrofill modules 309, 311, or 313 or to one of the three post-electrofill modules 315, 317, and 319.

In situations where the aligner module 331 is to be used to ensure that the wafer is properly aligned on back-end robot arm 325 for precision delivery to an either an electroplating module 309, 311, or 313, or an EBR module 315, 317, and 319 (assuming these PEMs perform EBR), back-end robot arm 325 transports the wafer to aligner module 331. In certain embodiments, aligner module 331 includes alignment arms against which back-end robot arm 325 pushes the wafer. When the wafer is properly aligned against the alignment arms, the back-end robot arm 325 moves to a preset position with respect to the alignment arms. In other embodiments, the aligner module 331 determines the wafer center so that the back-end robot arm 325 picks up the wafer from the new position. It then reattaches to the wafer and delivers it to one of the electroplating modules 309, 311, or 313, or EBR modules 315, 317, and 319.

Thus, in a typical operation of forming a layer of metal on a wafer using the electroplating system 307, back-end robot arm 325 transports a wafer from wafer cassette 329A or 329B to aligner module 331 for pre-electroplating centering adjustment, then to electroplating module 309, 311, or 313 for electroplating, then back to aligner module 331 for pre-EBR centering adjustment, and then to EBR module 315, 317, or 319 for edge bevel removal. Of course, in some embodiments, a centering/alignment step may be omitted if realignment of the wafer is typically not necessary.

As described above, the electroplating operation may involve loading the wafer in a clamshell type wafer holder and lowering the clamshell into an electroplating bath contained within a cell of one of electroplating modules 309, 311, or 313 where the electroplating is to take place. And, as described above, the cell oftentimes contains an anode which serves as a source of the metal to be plated (although the anode may be remote), as well as an electroplating bath solution oftentimes supplied by the central electrofill bath reservoir 323 along with optional chemical additives from a dosing system 333. The EBR operation subsequent to the electroplating operation typically involves removing unwanted electroplated metal from the edge bevel region and possibly the backside of the wafer by way of applying an etchant solution which is provided by chemical dilution module 321. After EBR, the wafer is typically cleaned, rinsed, and dried. Finally, after post-electrofill processing is complete, back-end robot arm 325 may retrieve the wafer from the EBR module and returns it to cassette 329A or 329B. From there the cassettes 329A or 329B may be provided to other semiconductor wafer processing systems such as a chemical mechanical polishing system, for example.

It is once again noted that the apparatuses and devices disclosed herein for preventing, reducing, or minimizing pH drift may be implemented within the context of the foregoing described electroplating cells, modules, and systems. Likewise, it is once again noted that the methods for preventing, reducing, or minimizing pH drift disclosed herein may be implemented within the context of electroplating methods performed in any of the foregoing described electroplating cells, modules, and systems.

Electroplating Systems which Reduce pH Drift

Accordingly, disclosed herein are electroplating systems for electroplating metal onto a semiconductor substrate which employ methods or devices for reducing or preventing pH drift in one or more electroplating cells. As described in detail above, without being limited to a particular theory, it is thought that the presence of oxygen in the electroplating solution within an electroplating cell causes an upwards pH drift during electroplating operations and also idle periods (the period between electroplating operations) which results in inferior quality of the layer of electroplated metal. Thus, as disclosed herein, an electroplating system may include an oxygen removal device for reducing oxygen concentration in the electrolyte solution used for electroplating operations. In some embodiments, the oxygen removal device may remove oxygen from an electroplating solution as it is flowed to one or more electroplating cells of the electroplating system.

Figure 4A:
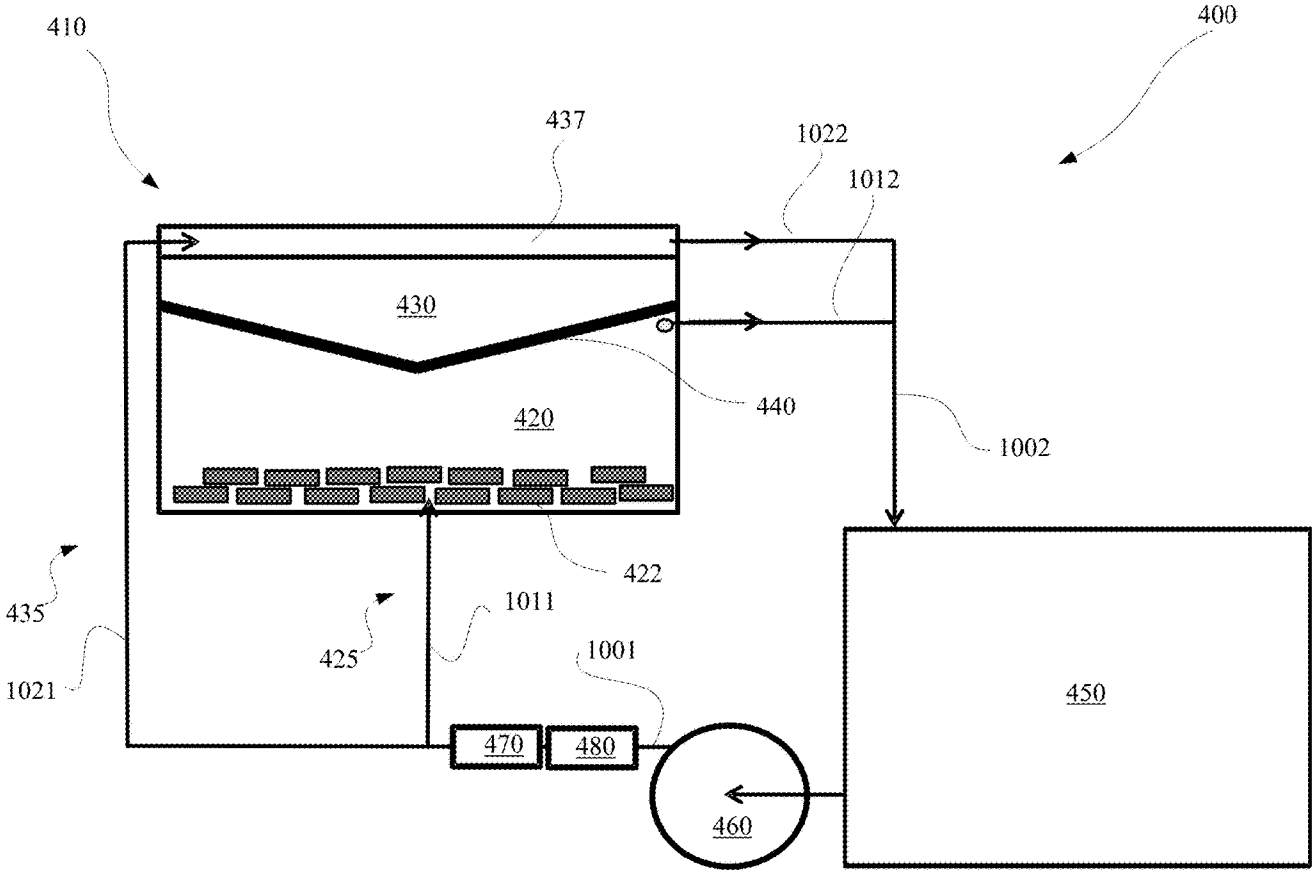
FIG. 4A schematically illustrates an electroplating system which employs an oxygen removal device for reducing oxygen concentration in an electroplating solution as it is flowed to an electroplating cell of the system.

For example, FIG. 4A schematically illustrates an electroplating systems 400 which, consistent with certain embodiments disclosed herein, employs an oxygen removal device 480 for reducing oxygen concentration in an electroplating solution as it is flowed to electroplating cell 410 of this system. In this embodiment, the electroplating cell 410 includes an anode chamber 420 and cathode chamber 430, which are separated by a porous membrane 440, similar to that shown in, and described with respect to, FIG. 3C above. The anode chamber, of course, is for holding one or more anodes during electroplating operations—anodes 422 in FIG. 4A and anode 460 in FIG. 3C, for example. Electroplating systems for electroplating nickel onto a semiconductor substrate would have nickel anodes in their anode chambers during electroplating, of course. The cathode chamber 430 encompasses the location in electroplating cell 410 where the surface of the substrate to be electroplated upon is contacted by the electrolyte solution while being held in a wafer holder, and where the actual deposition of metal onto the semiconductor substrate occurs. See also FIG. 3C, specifically, cathode chamber 740 within electroplating cell 755 where substrate 145 while being held in wafer holder 101 will be contacted by electrolyte solution. Note that in some embodiments, an electroplating system 400 may be configured to expose the electrolyte solution to the atmosphere while electroplating nickel onto a substrate. In these sorts of embodiments, the presence of an oxygen removal device 480 may be even more important due to the fact that the electrolyte solution may be absorbing oxygen from the atmosphere during electroplating operations.

While the electrolyte solution circulating through an anode chamber is generally referred to as anolyte, and the electrolyte solution circulating through a cathode chamber is generally referred to as catholyte, the two solutions may have substantially the same composition, depending on the embodiment, or they may have different compositions. Anolyte and catholyte may be circulated into and out of the anode and cathode chambers, respectively, by a system of fluid conduits, pumps, and/or valves. Described below are a few of the many possible configurations. The volume and flow rate of anolyte into the anode chamber may be substantially the same as the volume and flow rate of catholyte into the cathode chamber, however, in some embodiments the flow rates may differ. For example, in some configurations, a lower flow rate of anolyte into the anode chamber (relative to the flow rate of catholyte into the cathode chamber) may reduce the demand on the oxygen removal device operating on the anolyte solution. For example, in one embodiment, the flow rate of catholyte to the cathode chamber may be between about 12 and 48 liters/min, while the flow rate of anolyte to the anode chamber may be between about 1 and 4 liters/min. For 300 mm wafers, the overall flow rate of electrolyte (including anolyte and catholyte) to the electroplating cell may be between about 3 and 30 liters/min, or more particularly, between about 6 and 24 liters/min. For 450 mm wafers, the overall flow rate of electrolyte (including anolyte and catholyte) to the electroplating cell may be between about 7 and 68 liters/min, or more particularly, between about 14 and 54 liters/min.

A lower flow rate to the anode chamber may allow for the use of a smaller and less expensive oxygen removal device to achieve the same degree of oxygen concentration reduction. Alternatively, in some configurations, a lower oxygen concentration may be achieved in an anolyte solution for a given oxygen removal device by flowing less anolyte to it, and thereby lowering the demands on the particular oxygen removal device.

Whatever their respective compositions and flow rates, in some embodiments, the anolyte solution in the anode chamber and the catholyte solution in the cathode chamber may be separated by a porous separator 440 which permits passage of ionic current during electroplating, but inhibits (at least to a certain extent) the passage of electrolyte solution contained in the anode and cathode chambers 420, 430. In other words, at least to a certain extent, it prevents the mixing of anolyte and catholyte. This may be important if the anolyte and catholyte have different compositions, but even if they do not, the porous separator 440 may be important for preventing (at least to some extent) particulate matter from the anode chamber—perhaps generated as a result of anode decomposition—from entering the cathode chamber where the particulates could contact and contaminate the surface of the substrate to be electroplated upon. With this concept in mind, an anode chamber may be viewed broadly as a region of an electroplating cell that contains one or more metal anodes, this region separated by a barrier from another region of the electroplating cell that holds the wafer—i.e., the cathode chamber—wherein the barrier is such that it prevents (at least to a certain extent) contamination from the one or more metal anodes from reaching the cathode chamber.

However, it should also be noted that, in some embodiments, the anode chamber will containing an additional barrier which is configured or designed to prevent particles generated at the anode from contaminating the electroplating cell, or even other regions of the anode chamber itself. In some cases, this may be to prevent the porous separator 440 from becoming overwhelmed or overly inundated with particulate matter from the anode. Thus, in some embodiments, a bag may be used to surround the anode and encapsulate generated particles—oftentimes this is referred to in the art as "bagging the anode." In other embodiments, an additional membrane or filter, or broadly, another porous separator may be located very close to the anode within the anode chamber to localize anode generated particles, to the extent it is feasible.

More importantly, perhaps, is that in some embodiments, the porous separator 440 may be capable of maintaining a difference in oxygen concentration between the anode and cathode chambers 420, 430. This may be important, for example, if the oxygen removal device only removes oxygen from electrolyte solution delivered to the anode chamber—i.e. from the anolyte. Electroplating systems having electrolyte solution flow loops designed as such are described in detail below, for example, with respect to the oxygen removal device 480 of FIG. 4B. Depending on the embodiment, the porous separator may be an ion-exchange membrane, or in some embodiments, the porous separator may be a micro-porous membrane substantially free of ion exchange sites.

The oxygen removal device 480 (which is used to reduce oxygen concentration in the electrolyte solution as it is flowed to the electroplating cell 410) may in some implementations, specifically work to reduce the oxygen concentration in the electrolyte solution flowing to the anode chamber 420. In other implementations, the oxygen removal device may be used for reducing oxygen concentration in the electrolyte solution flowing to both the anode and cathode chambers. Furthermore, oxygen reduction may take place during electroplating operations, but the oxygen removal device 480 may also operate during idle times when the system is not performing any electroplating operations. Thus, in some embodiments, the oxygen removal device may be configured to reduce the oxygen concentration in the electrolyte solution flowing to the anode chamber during some or all idle times.

It is to be noted that in some electroplating systems, the electrolyte solution is kept flowing to the anode chamber during some or all idle times when the electroplating system is not electroplating. It is to be further noted that, despite being perhaps convenient to overall electroplating process flow and throughput, such circulation of electrolyte may actually increase the rate of consumption of hydrogen ions at the surface of a nickel anode, exacerbating what is thought to be the dominant reactive mechanism behind the observed pH drift, as described above. In particular, with respect to FIG. 1B, it was noted above that the effect of stirring a flask containing nickel anode rounds in an electroplating solution was to dramatically increase the observed rate of pH increase. Thus, it is thought that circulating electrolyte solution in the anode chamber, even while electroplating is not taking place, might result in an increased pH drift, and accordingly, it may oftentimes be the case that electroplating systems which circulate electrolyte solution through their anode chambers while idle may derive an even greater benefit from the oxygen reduction methods disclosed herein. Therefore, in certain embodiments, an oxygen removal device may be configured to reduce the oxygen concentration in the electrolyte solution flowing to the anode chamber during some or all idle times to a to a level such that the pH of the of electrolyte solution does not appreciably increase when contacting the nickel anode during idle time.

Various types of oxygen removal devices may be employed depending on the embodiment. For instance, one method of reducing oxygen concentration in the electrolyte solution is sparging the electrolyte solution. Sparging is a technique which involves bubbling a chemically inert gas through a liquid to remove dissolved gases from the liquid. An electrolyte solution may be sparged with helium, nitrogen, argon, etc., for example, in order to displace dissolved oxygen gas. Thus, in some embodiments, an electroplating system's oxygen removal device may be, or may include, a device for sparging the electrolyte solution with a gas substantially free of oxygen.

Another type of oxygen removal device which may be included in an electroplating system is a degasser. For a discussion of degassers and various degassing techniques, see U.S. patent application Ser. No. 12/684,792, filed Jan. 8, 2010, which is incorporated herein by reference. Note that a degasser may also be referred to as a contactor, and the terms are used interchangeably herein. In some embodiments, the degasser may be a membrane contact degasser and may work to reduce oxygen concentration in the electrolyte solution through the use of one or more membranes in combination with one or more vacuum pumps. Examples of commercially available membrane contact degassers include the Liquid-Cel™ from Membrana (Charlotte, N.C.), the SuperPhobic membrane contactor also from Membrana, and the pHasor™ from Entegris (Chaska, Minn.). In general terms, these membrane contact degassers work by applying a vacuum to the surface of the fluid to be degassed, and essentially pump the dissolved gas out of the fluid. The presence of one or more membranes increases the efficiency of the degassing operation by increasing the exposed surface are of the fluid to be degassed, thereby increase its exposure to the vacuum environment. Thus, the rate of removal of dissolved gases from an electrolyte solution by a membrane contact degasser may depend, for example, on the plating solution flow rate, the exposed area and nature of semi-permeable membrane across which a vacuum is applied to the degassing device, and the strength of the applied vacuum. Typical membranes used in membrane contact degassers allow the flow of molecular gasses but do not permit the flow of larger molecules or solutions which cannot wet the membrane.

In some embodiments, application of fluidic pressure to the fluidic inlet of a degasser may promote oxygen removal. For instance, the embodiment shown in FIG. 3A employs a pump 460 upstream in the same fluid loop as oxygen removal device 480 (more on fluid loops below) to drive electroplating solution into the fluidic inlet of the oxygen removal device. Thus, controlling the hydrodynamics of electrolyte solution flow through the flow loop containing the oxygen removal device via a pump or other mechanism may help to achieve a desired level of oxygen removal in a degassing device. Of course, while the presence of an oxygen removal device in a flow loop may dictate certain advantageous positioning for one or more pumps, a flow loop for electroplating solution will obviously have to have some form of pumping mechanism in place regardless in order to circulate the fluid.

One or more filters may be located in an electrolyte flow loop upstream from an electroplating cell so as to prevent particles or bubbles from entering the electroplating cell where they may result in defect formation in the layer of metal being electroplated. In some embodiments, such as that shown in FIG. 4A, a filter 470 may be located in a flow loop directly upstream from the electroplating cell 410 so that there is no intervening component which may expose the electroplating cell 410 to particle or bubble generation without at least some protection from the filter 470. In some embodiments, the filter may have a pore size of approximately 1 μm, and in certain such embodiments, 12-48 liters/min of electrolyte may be pumped through the filter in order to remove particle contaminants.

Pumps, in particular, are oftentimes responsible for the generation of bubbles in the fluid they are pumping, and so filter 470 downstream from pump 460 may reduce or prevent entry of bubbles into electroplating cell 410. Similarly, if a device for sparging the electrolyte solution is used as oxygen removal device 480, filter 470 downstream from oxygen removal device 480 may help to reduce or prevent bubble entry, and likewise, if the oxygen removal device 480 is a degasser such as a membrane contact degasser, the filter 470 may help to remove any particles generated from the fluid pressure applied on the degasser's membranes. In any event, whatever particular type or types of oxygen removal device(s) are employed, the devices are preferably located somewhere in the electrolyte flow loop or loops where they will not introduce bubbles or particles into the electroplating cell, and particularly not into the cathode chamber.

The oxygen removal device, whatever its type, should have the capability of reducing the dissolved oxygen concentration to a desirable level—typically to a level which reduces (or eliminates) the upward pH drift typically observed when an electrolyte solution contacts the anodes within the anode chamber of an electroplating cell. Thus, whether the oxygen removal device is (or includes) a degasser, or more specifically, a membrane contact degasser, or a device for sparging the electrolyte solution (e.g., with a substantially oxygen-free gas), in some embodiments, the oxygen removal device may be configured to reduce oxygen concentration in the electrolyte solution to a level of about 1 ppm or less. In certain such embodiments, the oxygen removal device may be configured to reduce oxygen concentration in the electrolyte solution to level of about 0.5 ppm or less. However, it should also be noted and understood that, in some embodiments, the oxygen concentration may be maintained at varying particular levels at different locations within the electroplating system. Thus, for example, in some embodiments, an oxygen removal device configured to reduce oxygen concentration within an electrolyte solution to some predetermined level, may reduce it to that level in the region of the electroplating system immediately downstream from the oxygen removal device, but not necessarily throughout the whole electroplating system. In particular, an oxygen removal device may be configured to achieve the predetermined oxygen concentration (e.g., 1 ppm or less, or 0.5 ppm or less) in the anode chamber downstream from the oxygen removal device but not necessarily in the cathode chamber. Fluid flow loops/paths to these chambers will be discussed in detail below.

An electroplating system, such as system 400 shown in FIG. 4A, may also employ a bath reservoir 450 which contains a reserve volume of electrolyte solution which may be circulated to and from electroplating cell 410 through one or more flow loops. Once again, specific flow loop configurations are discussed in detail below, but FIG. 4A shows that there are two flow loops fluidically coupling bath reservoir 450 to electroplating cell 410, since there are two paths circulating fluid may take when travelling from bath reservoir 450 to electroplating cell 410 and back. The bath reservoir 450 may be located outside the electroplating cell 410 as shown in FIG. 4A, or it may be formed integral to the physical structure forming the electroplating cell. Regardless of location, a bath reservoir would typically include one or more fluidic inlets which receive fluid from one or more fluid conduits (e.g., pipes), and one or more fluidic outlets which send fluid through one or more fluid conduits. The fluidic inlets may be downstream from the electroplating cell and the fluidic outlets upstream from the electroplating cell, etc. The bath reservoir may serve as a storage facility for electrolyte fluid, but it may provide other functions as well. In some embodiments, a bath reservoir 450 may provide an oxygen removal functionality or other electrolyte fluid treatment functionality, for example.

An electroplating system typically has at least one flow loop for flowing electrolyte solution to and from the electroplating chamber and the various components discussed above—pumps, filters, oxygen removal devices, etc. However, in some embodiments, an electroplating system may employ multiple flow loops for directing the flow of electroplating solution between the electroplating cell and the various components, and these flow loops may take on a variety of different configurations and fluidic connection topologies.

For example, in an electroplating system having separate anode and cathode chambers, there may be a flow loop referred to herein as an anode chamber recirculation loop which fluidically connects the anode chamber to various components of the electroplating system, and similarly, there may be a cathode chamber recirculation loop which fluidically connects the cathode chamber to various components of the electroplating system. In embodiments having such an anode chamber recirculation loop, the loop may be fluidically coupled to one or more fluidic inlets and fluidic outlets of the anode chamber, and be configured to flow the electrolyte solution through the anode chamber while electroplating nickel onto the substrate. Similarly, in embodiments having a cathode chamber recirculation loop, the loop may be fluidically coupled to one or more fluidic inlets and fluidic outlets of the cathode chamber, and be configured to flow the electrolyte solution through the cathode chamber while electroplating nickel onto the substrate. The anode chamber recirculation loop may simply be referred to herein as the "anode loop," and similarly, the cathode chamber recirculation loop may simply be referred to herein as the "cathode loop."

It should be understood that the anode loop and the cathode loop may share various fluid conduits within the electroplating system, however, the distinction is that fluid flow following the route of the anode loop flows to the anode chamber but not the cathode chamber, and likewise, fluid flow following the route of the cathode loop flows to the cathode chamber but not the anode chamber. An example is illustrated in FIG. 4A. In the figure, electroplating system 400 has a separate anode chamber 420 and cathode chamber 430 which are fluidically coupled to other components of electroplating system 400 through an anode chamber recirculation loop 425 (or, "anode loop") and a cathode chamber recirculation loop 435 (or, "cathode loop"), respectively. The direction of fluid flow through the flow loops and various fluid conduits is indicated by the arrows in the figure. As shown in the figure, anode chamber recirculation loop 425 comprises fluid conduit sections 1001, 1011, 1012, and 1002, and cathode chamber recirculation loop 435 comprises fluid conduit sections 1001 1021, 1022, and 1002—and so it should be noted that the two circulation loops share certain fluid conduits (1001 and 1002), but that nevertheless the anode chamber recirculation loop 425 directs fluid to the anode chamber and not to the cathode chamber, and vice versa with respect to the cathode chamber recirculation loop 435. (For sake of simplicity, conduit 1001 is referred to in a unitary fashion and by a single reference number though it is broken up in the figure by components 460, 470, and 480 and would likely—though not necessarily—be implement as three physical pipes/conduits. It should be kept in mind that FIG. 4A is a schematic.) Also included in the cathode loop is flow manifold 437, representing the entry point of electrolyte solution into cathode chamber 420. In some embodiments, a flow manifold 437 may help to distribute electrolyte solution into cathode chamber 430, however, it's presence is obviously not a requirement.

Thus, in systems having both anode and cathode chamber circulation loops, the various components of the electroplating system used to support electroplating operations in the electroplating cell may be connected to the cell via either the anode chamber circulation loop, the cathode chamber circulation loop, or both. For instance, the bath reservoir 450 of the electroplating system 400 of FIG. 4A is fluidically coupled to electroplating cell 410 via both the anode loop 425 and the cathode loop 435, as these loops have been defined and described in detail above. It can be seen from FIG. 4A that the fluidic outlet of the bath reservoir is fluidically coupled to both the anode loop and the cathode loop schematically through fluid conduit 1001. Similarly, FIG. 4A schematically shows the fluidic inlet of bath reservoir 450 fluidically coupled to conduit 1002 which carries electrolyte fluid from both the anode loop 425 and the cathode loop 435. However, depending on the embodiment, the fluidic inlets and outlets of a bath reservoir may instead be coupled to just an anode loop and not a cathode loop, or to just a cathode loop and not an anode loop.

In electroplating systems where one or more oxygen removal devices are employed to combat pH drift, the location of the one or more oxygen removal devices in the flow loops of the electroplating system may be an important consideration. For example, in FIG. 4A, the oxygen removal device 480 is located in both the anode and cathode loops, 425 and 435 (respectively), upstream from both the anode and cathode chambers, 420 and 430 (respectively), but downstream from bath reservoir 450. Such an oxygen removal device 480 may include a degasser such as a contact membrane degasser, or a device for sparging the electrolyte solution with a substantially oxygen free gas, or both, as described in detail above.

Figure 4B:
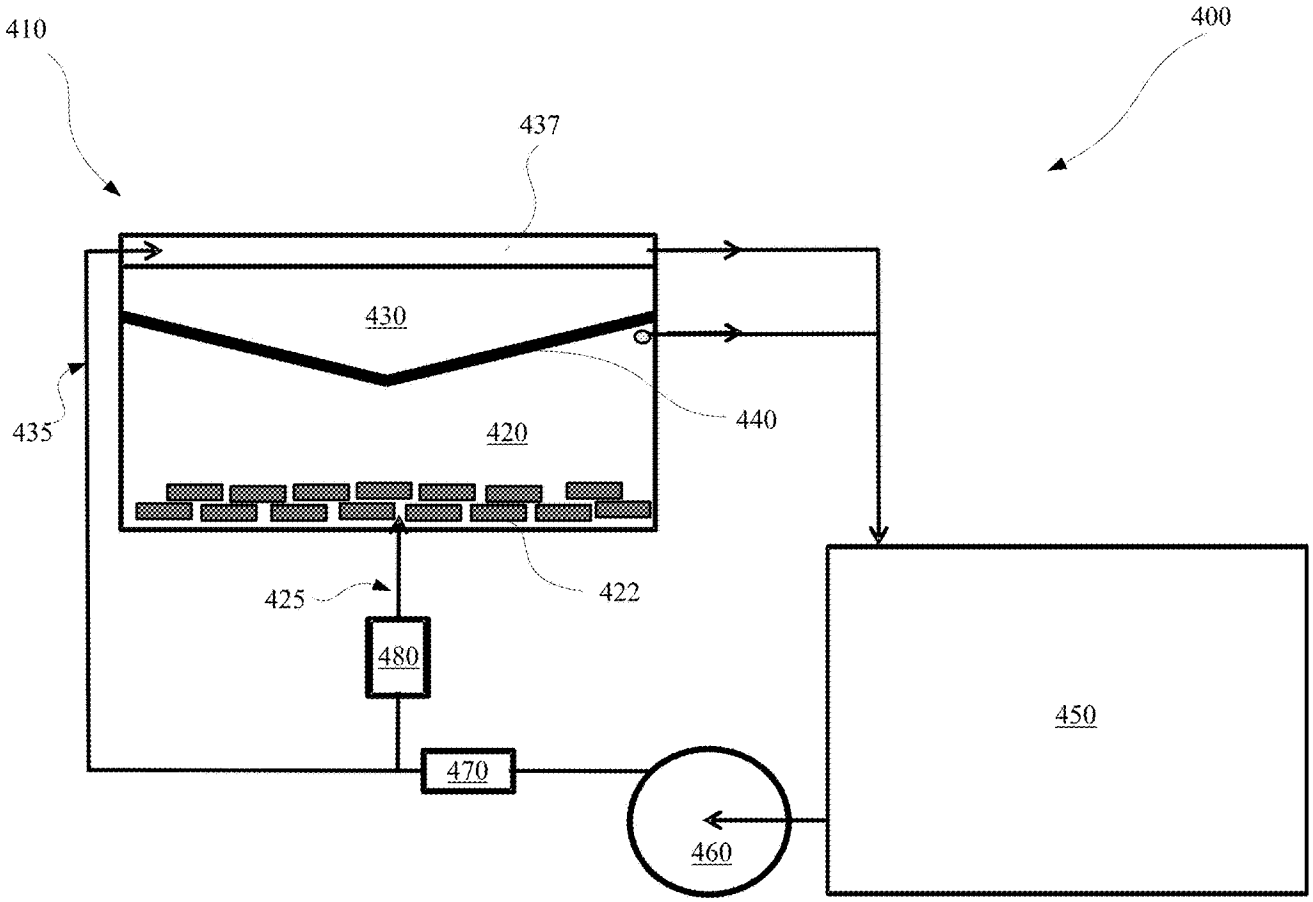
FIG. 4B schematically illustrates another embodiment of an electroplating system which employs an oxygen removal device for reducing oxygen concentration in an electroplating solution as it is flowed to an electroplating cell of the system.

However, in other embodiments, an oxygen removal device may be exclusively located in either the anode loop or the cathode loop. For instance, FIG. 4B schematically illustrates an electroplating system 400 quite similar to that illustrated in FIG. 4A. Like the system of FIG. 4A, electroplating system 400 of FIG. 4B includes an electroplating cell 410 having an anode chamber 420 and a cathode chamber 430 separated by a porous membrane 440, a bath reservoir 450, pump 460, filter 470, anode loop 425, cathode loop 435, etc. However, whereas in FIG. 4A, the oxygen removal device 480 was located in both anode and cathode loops, here oxygen removal device 480 is located exclusively in the anode loop 425. As a result, electrolyte solution passing through and being treated by oxygen removal device 480 will be flowed to anode chamber 420 and not to cathode chamber 430 (ignoring, of course, any back-diffusion of electrolyte solution across porous separator 440). Thus, it can be said that the oxygen removal device 480 of FIG. 4B is located in the anode loop 425 upstream from the anode chamber 420 and downstream from the bath reservoir 450, but not located in cathode loop 435. Once again, such an oxygen removal device 480 may include a degasser such as a contact membrane degassers, or a device for sparging the electrolyte solution with a substantially oxygen free gas, or both, as described in detail above.

The placement of filter 470 relative to oxygen removal device 480 as well as anode and cathode loops, 425 and 435, is another point of distinction between the embodiments shown in FIGS. 4A and B. In both embodiments, filter 470 is located in both anode and cathode loops, 425 and 435, which may be an advantage in some cases because a single filter component may be used to filter both the electrolyte solution flowing to the anode chamber 420, and also the electrolyte solution flowing to the cathode chamber 430. Thus, for example, in FIG. 4A, since filter 470 is located downstream from pump 460 and bath reservoir 450, but upstream from both the anode chamber 420 and cathode chamber 430, it may protect both from any particles, debris, bubbles, etc. generated within reservoir 450 or from pump 460.

However, in addition, in FIG. 4A, filter 470 is also downstream from oxygen removal device 480, and thus it may also protect both anode and cathode chambers from particle, debris, and bubbles generated from the oxygen removal device (e.g. bubbles from a sparging device, particulate matter from the membranes of a degasser, etc., as described in detail above). Thus, filter 470 can be described as located in the anode chamber recirculation loop 425 upstream from the anode chamber 420 and downstream from the oxygen removal device 480 and the bath reservoir 450.

Contrastingly, in the embodiment schematically illustrated in FIG. 4B, while filter 470 remains located on both loops and so filters electrolyte flowing to both chambers, the oxygen removal device 480 is located exclusively on the anode loop 425, and because of this location, it is downstream from filter 470. Thus, in the embodiment of FIG. 4B, the electrolyte solution exiting oxygen removal device 480 will not receive the benefit of filtration from filter 470 prior to entering anode chamber 420. This may or may not be a problem depending on the extent to which oxygen removal device 480 generates bubbles or particles in the electrolyte solution which require filtering. If such filtering is required, or at least somewhat beneficial, it is possible to put an additional filter in anode loop 425 downstream from oxygen removal device 480.

Nevertheless, despite the fact that locating oxygen removal device 480 exclusively in anode loop 425 may place it downstream from filter 470, as shown in FIG. 4B, such placement may have other benefits. For instance, because the dominant mechanism behind pH drift is thought (as explained above) to involve the extent to which there is dissolved oxygen in the electrolyte solution contacting the nickel anodes contained in the anode chamber, oxygen removal within the anode loop is typically more important than oxygen removal within the cathode loop. Accordingly, it may be more effective to locate an oxygen removal device 480 within anode loop 425, but not in the cathode loop 435, so oxygen removal efforts can be focused on the electrolyte solution flowing to the anode chamber 420. For example, in certain embodiments, a smaller and more cost-effective oxygen removal device may be used if it is only required to process solution flowing to the anode chamber. Moreover, in certain embodiments, a lower oxygen concentration may be achieved by focusing oxygen removal efforts on a smaller volume of electrolyte solution flowing to the anode chamber. For example, in some embodiments, locating the oxygen removal device 480 in the anode loop upstream from the anode chamber, but not upstream from the cathode chamber, as shown in FIG. 4B, allows oxygen concentration in the anolyte flowing to the anode chamber to be lowered to below about 0.5 PPM, or even below about 0.4 PPM, or even below about 0.3 PPM or even below about 0.2 PPM, or even below about 0.1 PPM.

Fluid flow through an electroplating system's flow loops such as anode chamber recirculation loop and cathode chamber recirculation loop may be controlled by a system of pumps, valves, or other types of fluid flow control devices, and fluid flow may be sensed or measured by various types of flow meters, etc. Furthermore, the oxygen concentrations and/or pH levels of electrolyte solution flowing through the various flow loops and conduits, as well as electrolyte solution in the anode and/or cathode chambers, may be sensed, measured, and/or determined by one or more oxygen sensors and/or pH sensors located within an electroplating system and configured to measure the concentration of oxygen in the electrolyte solution and/or the pH level of the electrolyte solution. In addition, an electroplating system may include logic for operating an oxygen removal device in response to values output by a pH sensor (or pH meter), and likewise, an electroplating system may include logic for operating an oxygen removal device in response to values output by an oxygen sensor.

Moreover, a system controller for the electroplating system may monitor, operate, and/or control the various sensors (e.g., fluid flow, oxygen, pH), various devices for fluid flow control (e.g., pumps, valves), devices for oxygen removal and/or control, or other devices and components which may be present in an electroplating system. A system controller is not explicitly shown in FIG. 4A or B—though one may be present in electroplating system embodiments configured in accordance with these figures—but see electronics unit 339 of FIG. 3D which may serve as a system controller for electroplating system 307, as described above. System controllers are described in more detail below.

With regards to oxygen sensors, in some implementations, the concentration of oxygen in the electrolyte solution may be monitored at one, or two, or three, or more locations in an electroplating system, and in particular, in its flow loops, anode chamber, and/or cathode chamber. Referring again to FIGS. 4A and 4B, an electroplating system 400 may include one or more oxygen sensors in the bath reservoir 450, in the anode chamber 420, the cathode chamber 430, the anode loop 425, the cathode loop 435, or elsewhere in the electroplating system. An oxygen sensor may be a commercially available oxygen probe such one made by In-Situ, Inc. (Ft. Collins, Colo.). In other embodiments, a hand-held oxygen meter may be employed, such as a commercially available meter made by YSI, Inc. (Yellow Springs, Ohio).

With regards to pH sensors, in some implementations, the pH level of the electrolyte solution may be monitored at one, or two, or three, or more locations in an electroplating system, and in particular, in its flow loops, anode chamber, and/or cathode chamber. Referring again to FIGS. 4A and 4B, an electroplating system 400 may include one or more pH sensors in the bath reservoir 450, in the anode chamber 420, the cathode chamber 430, the anode loop 425, the cathode loop 435, or elsewhere in the electroplating system. pH level may be measured directly by onboard pH meters, or it may be measured or estimated through the use of off-line bath metrology data. One suitable example of a commercially available off-line pH meter is the Symphony SP70P.

With regards to system controllers, a suitable system controller may include hardware and/or software for (approximately) controlling oxygen concentrations and/or pH levels of the electroplating solution circulating in the electroplating system, and for generally accomplishing the operations and associated processes for electroplating one or more semiconductor substrates. The controller may act on various inputs including user inputs, but also sensed inputs from, for example, oxygen or pH sensors located at one or more positions within the electroplating system. In response to various inputs, a system controller may execute control instructions for causing the electroplating system to operate in a particular manner. For example, the controller may adjust the level of pumping, the positions of one or more valves and the fluid flow rates through one or more flow loops, the level of oxygen removal performed by one or more oxygen removal devices, or adjust other controllable features of the electroplating system. For example, the system controller may be configured to operate one or more oxygen removal devices to achieve an oxygen concentration less than or about equal to a certain value, such as, for example, less than or about 1 ppm, or more particularly, less than or about 0.5 ppm. The system controller will typically include one or more memory devices and one or more processors configured to execute instructions stored on machine readable media so that the electroplating system will perform in accordance with the disclosed implementations. Machine-readable media containing instructions for controlling process operations in accordance with the disclosed implementations may be coupled to the system controller.

Electroplating Systems Having Devices for pH Adjustment after pH Drift

While preventive measures—such as reducing the oxygen concentration of electrolyte solution in the anode chamber—represent a strategy for reducing pH drift, another approach is to equip an electroplating system with a device for adjusting electrolyte solution pH level once a certain amount of pH drift is detected or predicted to have occurred. And, a combination of these two approaches, may work even better still.

Accordingly, disclosed herein are pH adjustment devices which may be incorporated into an electroplating system and used in conjunction with an oxygen removal device to prevent, reduce, or correct pH drift and thereby improve the quality of electroplated metal layers. It is noted that such pH adjustment devices (and associated methodologies) have already been described in great detail in U.S. patent application Ser. No. 13/706,296, filed Dec. 5, 2012, and titled "APPARATUSES AND METHODS FOR CONTROLLING PH IN ELECTROPLATING BATHS," and accordingly, this previous patent application is hereby incorporated by reference in its entirety and for all purposes, but particularly for the purpose of describing the implementation and use of the aforementioned pH adjustment devices in electroplating systems having oxygen removal devices. Note that the terms or phrases "bath," "electroplating bath," "electroplating bath solution," "electroplating solution," "plating solution," "electrolyte plating solution," and "electrolyte solution" are used interchangeably herein.

As described in detail in the aforementioned patent application, certain pH adjustment devices disclosed therein may work to lower the pH of an electrolyte solution through generating free hydrogen ions in the solution by electrolyzing one or more components of the electroplating bath. For instance, water is typically used as a solvent in nickel plating electrolyte solutions, and the electrolysis of water at an electron-adsorbing anode submersed in the bath generates four hydrogen ions and one oxygen molecule for every two water molecules electrolyzed:

$$2H_2O(l) \rightarrow O_2(g) + 4H^+ + 4e^- \quad (11).$$

In nickel electroplating, the cathodic reaction corresponding to anodic Reaction 11 is generally the reduction of nickel (at the wafer itself, or more generally at an auxiliary cathode).

The anode used to adsorb the electrons generated by Reaction 11 may be an inert auxiliary anode, and it may be embodied in a variety of shapes, sizes, and configurations. It may be made from and/or coated with a variety of materials, and it may be exposed to the bath at a variety of locations within the electroplating cell. It is referred to here as an auxiliary anode because an electroplating cell typically already has another anodic electrode—typically the main anode which is an active (non-inert) metal anode serving as a source of the metal to be electroplated upon some target cathodic surface, typically a wafer substrate. The main active nickel anode or anodes may be, for example, the nickel anode rounds 422 shown in FIGS. 4A and 4B. Moreover, since the generation of free hydrogen ions in the bath occurs through a reaction occurring at or near the surface of the auxiliary anode (e.g. the electrolysis of Equation 11), the auxiliary anode is generally referred to herein as an acid generating surface or "AGS."

The cathodic plating efficiency in nickel electroplating, as mentioned above, is typically around 97-99%, and so is generally lower and less efficient than the main anode metal half reaction (often nearly 100% efficient), leading to overall inefficiency, and an increase in metal content and increase in pH of the bath. If one were to use an inert anode undergoing Reaction 11, instead of a metallic anode, then the anodic efficiency for metal generation at the main anode would be zero (0%) and the metal content in the bath would decrease and the pH would decrease over time. Therefore, these two main anode approaches (active vs. inert) lead to contrary results in bath pH and metal content over time. The net overall efficiency for the latter case (active metal anode) is much closer to balance, but is not perfect. By using a small amount of AGS inert anode reaction while plating, one can fairly rapidly restore the metal and acid/pH balance. Because the cathodic plating inefficiency is not necessarily constant in time or with processing condition, nor can it be easily predicted with absolutely certainty over very long periods of time (several months or a year), a means of not only predicting the amount of charge required to pass on the AGS versus time is required, but also some measurement of metal and bath pH may be needed periodically to control the bath composition. Some embodiments disclosed herein therefore enable a technique wherein a relatively small amount of charge (compared to that plated on the workpieces) is passed using an AGS configuration (an inert anode oxygen electrode coupled with a metal deposition cathode) to restore the balance from the typically 97-99% efficiency and an associated pH rise and metal decrease, and includes a periodic use of an AGS, coupled though predictions of inefficiencies, and/or measurements of the pH and/or metal content in the bath, to turn on the AGS system periodically until the pH and/or metal content of the bath is restored to the target values.

In order for it to perform its acid generating function, during acid generation, the AGS is typically biased sufficiently positive relative to some AGS counterelectrode (an AGS cathode) such that the AGS can adsorb electrons from the appropriate component (after releasing them from the component) of the electrolyte solution and generate free hydrogen ions at the AGS's surface. The adsorbed/released electrons may then transverse an external circuit and then be transferred to the AGS cathode surface where they may be adsorbed by (and thereby reduce) another component of the electrolyte solution. The (AGS) counterelectrode (or AGS cathode) may be one and the same as the counterelectrode used in electroplating operations, or it may be distinct from the counterelectrode used in electroplating operations. However, since in electroplating, the substrate is typically biased negative relative to a main (typically active metal) anode such that metal ions from the electrolyte solution are reduced and plated onto the substrate surface, during acid generation, some electrical reconfiguration (perhaps by switching various electrical relays) may be required such that the AGS may be biased sufficiently positive relative to this counterelectrode to cause acid generation. In any event, the AGS works to lower the pH of the electrolyte solution. Thus, a method of electroplating metal and adjusting electrolyte solution pH may include exposing a substrate surface and counterelectrode to an electrolyte solution, biasing the substrate surface sufficiently negative relative to the counterelectrode such that metal ions are reduced and plated onto the substrate surface, and biasing the AGS sufficiently positive relative to the counterelectrode such that free hydrogen ions are generated. In some embodiments, as described above in reference to Reaction 11, pH adjustment may be accomplished by freeing hydrogen ions through electrolysis of water molecules at the AGS.

The electrons adsorbed by the anodic AGS may be directed via a conductive path to a cathodic surface in contact with the electrolyte solution and be used to reduce solvated metal cations in the electrolyte solution. This reduction of solvated metal ions causes uncharged elemental metal to plate out onto the aforementioned cathodic surface, thereby lowering the metal ion concentration in the bath. Reaction 12 illustrates this for $Ni^{2+}$:

$$Ni^{2+}(l)+2e^{-}\rightarrow Ni(s) \quad (12)$$

Thus, in some embodiments, the concentration of metal ions in the electrolyte solution may be effectively lowered through the electrochemical reduction of a portion of the metal ions to a non-ionic metal species which plates out onto the counterelectrode. Furthermore, in some embodiments, the amount of charge used to plate out metal from the electrolyte solution may be roughly related to the total charge of the electrons freed at the AGS. Moreover, in some embodiments, the electrochemical reduction of some portion of the solvated metal ions may occur roughly or substantially in proportion to the charge transferred by generating free hydrogen ions at the AGS. Accordingly, in some embodiments, the electrolysis occurring at the AGS and the plating of metal onto the cathodic surface substantially balance out. Because of this potential balancing, at least in principle, the process of generating hydrogen ions and using a portion or all of the freed electrons to reduce metal ions and plate elemental metal is generally referred to herein as a metal-to-acid (MTA) process. The phrase is used because, to some extent, the aforementioned process results in an effective exchange of metal ions for hydrogen ions in the bath, as illustrated in Reaction 13:

$$2Ni^{2+}(l)+2H_2O(l)\rightarrow 2Ni(s)+O_2(g)+4H^{+} \quad (13)$$

Of course, it should be understood that the metal-to-acid exchange does not have to be perfect, complete, or even with a defined proportionality for a process to constitute a MTA process as that term is used herein. Stated alternatively, as long as a significant fraction of the electrons freed at an AGS are used to reduce metal ions to a solid form thereby lowering their concentration in the electrolyte solution, the process is generally referred to herein as an MTA process. In any event, an MTA process to adjust for pH drift is advantageous because the drift issues described above are most typically accompanied by the generation of excess solvated metal ions—$Ni^{2+}$ for example—and the MTA process has the potential to ideally exchange metal ions for hydrogen ions with the correct proportionality for reversing the imbalance which is created by Reactions 1 through 7 above. And, as an additional potential benefit, for electroplating baths having for whatever reason extraneous metal ions more noble than the metal being electroplated (e.g. $Cu^{2+}$ ions in a $Ni^{2+}$ sulfamate electroplating bath), the plating out of the excess primary metal ion (e.g. $Ni^{2+}$) will be accompanied by the plating out of these extraneous more noble metal ions ($Cu^{2+}$). Thus, in embodiments where this occurs, MTA processes may even further improve electroplating bath composition. As a result, MTA processes enable the extension of the bath life, potentially reducing bleed & feed requirements, as well as obviating the need for any sulfamic acid dosing regimen.

In some embodiments, a typical MTA process may be carried out in a galvanostatic fashion, with current operating between about 0.01 to about 10 amperes per liter (A/L) of electroplating bath fluid, or about 0.05 A/L to about 5 A/L, or about 1 A/L to about 4 A/L. Depending on the embodiment, a suitable amount or duration of an MTA process may be described in terms of the total amount of charge (e.g., in coulombs) to be preferably transferred via the MTA process. In some embodiments, a measurement of pH may be used to estimate the appropriate target charge quantity to be transferred in an MTA process for a given electroplating bath volume to restore the target pH value. In some embodiments, a measurement of metal content may be used to estimate the appropriate target charge quantity to be transferred in an MTA process for a given electroplating bath volume to restore the target pH value or the target metal content. The relationship between target charge quantity and current pH level may be determined experimentally or by literature data and calculations. Current pH level may be measured directly by onboard pH meters, or it may be measured or estimated through the use of off-line bath metrology data. In any event, current pH level or metal content may provide a mechanism of estimating the amount or duration of MTA process appropriate for a given electroplating bath.

However, pH level or metal content are not the only routes to estimating appropriate MTA amount or duration. In some embodiments, systems idle time since the last MTA operation, and/or the charge passed by electroplating processes since the last MTA operation may provide a suitable basis for estimating the amount of charged preferably transferred in a subsequent MTA operation. The target charge quantity to be transferred via a subsequent MTA operation is referred to herein as an "MTA charge deficit," and the relationship between the "MTA charge deficit" and the system idle time and/or the plating charge passed will typically depend on the particular electroplating bath chemistry as well as the design of the electroplating equipment. In some embodiments, the target "MTA charge deficit" to be transferred as a function of plating charge passed or system idle time has already been characterized for a particular system, and so by tracking these quantities, the "MTA charge deficit" may be accumulated during electroplating operations, so that when an opportunity to perform an MTA process arises (such as because of a scheduled gap in electroplating), the appropriate amount or duration of MTA process to preferably execute is known. In certain such embodiments, an MTA process may be queued up in an electroplating apparatus's scheduling control mechanism (e.g. operating software) once a pre-specified minimum MTA charge deficit is met, and once a suitable gap in electroplating operations arises, the appropriate amount or duration of MTA process could be performed to match the known MTA charge deficit (or at least performed for some maximum allowable time, whichever occurs first).

The pH adjustment and/or MTA processes and apparatuses disclosed herein may be generally used, depending on the embodiment, with any metal electroplating system using an active anode whose cathodic plating efficiency is lower than the anodic dissolution efficiency, or with any electroplating system employing electrolyte solution chemistry which exhibits upward pH drift during electroplating or idle periods. Therefore, apparatuses and methods disclosed herein are generally potentially applicable to the electroplating of metals that are plated at a potential below (or more negative than) the hydrogen evolution potential at pH 0 (0V vs. NHE), and more generally if the metal reduction potential is below the stability of water to form hydrogen at the pH of the bath being used. Some examples of metals in this class of material include nickel, cobalt, indium, zinc, cadmium, chromium, antimony, tin and lead, and alloys of these materials. Examples of plating chemistries whose use may be benefited from the pH adjustment and/or MTA processes and apparatuses disclosed herein include, but are not limited to: iron and iron alloy plating sulfate, sulfamate, chloride, and/or fluoroborate based baths, indium plating sulfamate based baths, acid bromide based cadmium plating baths, and acid chloride zinc plating baths.

The formation of complexes of metal ion in a bath, which drives the potential for reduction to more negative values than the uncomplexed state, can also lead to a net inefficiency and co-hydrogen evolution reaction at the workpiece cathode, in the plating of an otherwise relatively noble metal as well. So, for example, use of a strongly complexed solution of copper (normal reduction potential about 0.34V vs. NHE), can become negative of the NHE in a sufficiently strongly complexed environment.

As indicated, a variety of materials may be used for forming an AGS. In some embodiments, these materials may be similar to those known in the art for dimensionally stable inert electrodes (DSA's). In some embodiments, suitable materials include electrically-conductive, non-corroding or corrosion-resistant materials which do not substantially corrode in the electroplating bath of interest. In certain such embodiments, the corrosion-resistant material may be coated with an oxygen evolving noble catalyst. In some embodiments, the corrosion-resistant underlying substrate material may comprise one or more metals such as, for example, titanium, tantalum, niobium, and zirconium. In some embodiments, a body is formed from one or more of these corrosion resistant materials, and the body is covered (or partially covered) with a catalytic coating capable of promoting the hydrogen ion generating reaction at the AGS (such as by improving the kinetics of $H_2O$ electrolysis). It is important, of course, for the corrosion-resistant material making up the body of the AGS, whether it be a metal or some other type of material, to be compatible with the catalytic coating. The metals listed above are suitably compatible. Appropriate catalytic coatings for enhancing water hydrolysis include platinum, or one or more metal oxides selected from the oxides of platinum, niobium, ruthenium, iridium and tantalum. Suitable catalytic coatings which are commercially available include, but are not limited to, Siemens Optima® anode coatings, which are comprised of mixed metal oxides such as iridium and tantalum oxides (Optima IOA-HF), or platinum (Optima IOA-PTA).

In addition, as indicated above, many configurations are possible for the AGS, in terms of size, shape, placement, orientation, and so forth, and various specific AGS embodiments are disclosed in detail below in the context of FIGS. 5A, 5B, and 5C. Of course, these embodiments are described in detail in order to illustrate the inventive concepts disclosed herein, with the understanding that these inventive concepts are not to be construed as limited in scope to the specifically described AGS configurations. Since it is the surface of the AGS which enhances the hydrogen ion generating reaction (e.g. by improving the kinetics of $H_2O$ electrolysis), generally a structure with a high surface area per unit volume may be preferred in some instances. In some embodiments, a mesh like structure provides such a high surface area per unit volume. Also note that although the AGS is an anodic surface which functions separately from the usual anodic and cathodic surfaces present in an electroplating cell—i.e. the cathodic wafer substrate and the anodic metal ion source—the AGS may be biased with an anodic electrical potential by sharing the power supplies typically present in an electroplating cell—albeit in some instances with modifications. For instance, as will be described in more detail below, in some embodiments, the AGS may be biased with a positive anodic potential through the same lead and power supply typically providing a negative cathodic bias to the substrate. This may be accomplished, in some instances, by switching or reversing the polarity of the power supply or by using relays to change the connectivity of the power supply to the substrate leads.

Depending on the embodiment, an AGS may be viewed generally in connection with a pH adjustment and/or control procedure forming a subpart of method of electroplating a set of substrates, or it may generally be viewed as a pH adjustment and/or control related component of a substrate electroplating apparatus or system. Accordingly, it is useful to provide descriptions and illustrations of several possible AGS implementations which may be used within an electroplating system. Once again, however, it should be understood that the electroplating systems disclosed below are described in order to illustrate generally, but in concrete terms, various potential AGS related configurations and pH control applications. The specific hardware disclosed is not intended to limit the scope of the disclosed AGS-related inventive concepts. Moreover, it should be understood that any of the AGS configurations and implementations described below in the context of FIGS. 5A, 5B, and 5C may be used in combination with an oxygen removal device as described above and as shown in FIGS. 4A and 4B.

An AGS is typically used with an electroplating cell which houses an anode serving as a counterelectrode to the substrate during electroplating and also as a source of the metal to be electroplated onto the substrate. In some embodiments, this anode may also serve as a counterelectrode to the AGS. In other embodiments, the AGS may be biased relative to a different counterelectrode. The AGS itself may or may not be formed integrally with the electroplating cell as will be explained in more detail below. In some embodiments, there is a self-contained AGS system having its own electrodes, pH meter, power supply and controller, which can communicate with the main plating tool apparatus controller (as needed, e.g. to track wafer or charge passed through a bath). A portion of the elements of the system (i.e. a select list of elements of the system) may be placed in, mounted into, or hung over the wall and into the liquid of the bath (e.g. allowing the immersion of the electrodes and/or pH meters into the bath electrolyte). The select sub-list of element of the system may include 1) an AGS inert dimensionally stable anode 2) a cathode suitable for extracting by plating the metal contained in the bath (e.g. a cathode made of the metal of the bath, or a platinum coated substrate, which can be subsequently plated with the metal of the bath, and later etch of the bath plated metal and undergo regeneration of a exposed Pt surface from time to time), 3) electrical connections to the electrodes, and 4) a pH probe. System parts not immersed in the bath may include a power supply for passing current between the electrodes, a controller in communication with a pH probe that translates the signal of the pH probe to a pH reading that monitors the pH of the bath, as well as take the signal from the probe and determine how and when to control/initiate the power/current to the power supply the current and charge vs. time. The electroplating cell may also include one or more fluidic connectors configured for establishing a fluidic connection between the electroplating cell and an external container serving as a reservoir of electroplating bath fluid. In some embodiments, the AGS and possibly its counterelectrode may be located in this external container. The fluidic connectors may also be configured to circulate the electroplating bath fluid throughout the plating cell and possibly directing it against the surface of the substrate being electroplated. Furthermore, in some embodiments, the electroplating cell may include membranes or other separators designed for fluidically separating, to a certain extent, an anode compartment and a cathode compartment so that different electroplating bath fluid chemistries may be maintained in the two compartments.

In electroplating systems having multiple electroplating cells, the substrate electroplating performed in each of the electroplating baths of these cells may be accompanied by a bath pH maintenance and/or adjustment procedure employing an acid generating surface (AGS) as described above. In some embodiments, a data processing system within or connected to the automated electroplating apparatus tracks the ongoing electroplating taking place within the individual cells as well as the bath composition and/or pH of the bath contained in each cell. When the data processing system determines that the pH level of the electroplating bath fluid contained within a particular electroplating cell is (or is likely to be) beyond the necessary and/or desirable pH range, the data processing system may initiate an AGS-based pH adjustment procedure for the given electroplating bath. Considerations the data processing system may rely on when determining whether a given cell is, or is likely to be, out of range include, but are not limited to: one or more direct measurements of the pH level in the particular cell, a count or estimate of the number of substrates plated in the particular cell since the last pH correction procedure was performed, a count or estimate of the total charge transferred through the electroplating processes performed in the particular cell since the last pH correction operation, the amount of time the particular electroplating cell has sat idle since the last pH correction operation, and/or the accumulated MTA charge deficit (as described above) corresponding to the particular electroplating cell. If the data processing system does determine that a cell's bath pH level is, or is likely to be, outside the desirable pH range, the data processing system may or may not initiate an AGS-based pH correction procedure based upon further considerations which may include, but are not limited to, how far a particular cell's bath pH level is outside the desired range and whether or not the particular out-of-range cell is currently electroplating a substrate—if so, likely justifying delaying pH correction at least until completion of this substrate. In some embodiments, the MTA process is carried out for only very short time periods, in parallel with post substrate electroplating steps such as during substrate rinse, reclaim, and substrate removal steps.

Another set of considerations which may be taken into account by a data processing system in its determination of whether or not to initiate AGS-based pH correction relate to the states of the other cells in the electroplating system. In some embodiments, timing the initiation of AGS-based pH correction with respect to an individual electroplating bath may include the measured bath pH levels of the other electroplating cells, the accumulated MTA charge deficit (as described above) of the other electroplating cells, the identification of the cell having the electroplating bath with the highest pH or highest MTA charge deficit, whether or not sustaining or achieving acceptable substrate processing throughput demands a substrate be immediately electroplated, and relatedly, whether or not there are any other cells immediately available to accept a substrate for electroplating.

If a decision is made within the data processing system to initiate an AGS-based pH adjustment procedure, in some embodiments, the system will begin by designating as temporarily unavailable the cell or cells to be pH corrected. After so designated, an AGS-based pH adjustment procedure would be initiated on the designated cells and electroplating postponed. After completion of pH adjustment, with pH level now within an acceptable range, the data processing system would re-designate these cells available for plating, and the cells would remain so designated until these particular cells once again met the criteria for pH adjustment.

While this decision-making with respect to initiation of AGS-based pH correction has been described in the context of a data processing system, it is, of course, readily appreciated by one skilled in the art that the foregoing considerations and decision-making with respect to initiation of AGS-based pH correction may be exercised manually by an operator of any electroplating apparatus having a set of more than one electroplating cell. In some embodiments, it is preferable to automate the decision-making process and analysis of the foregoing considerations using a data processing system as described above, however, in other embodiments, manual analysis and control may be advantageous and preferred.

Another multi-cell electroplating system configuration which may employ an AGS involves an electroplating bath reservoir which is shared via fluidic coupling by two or more or all of the electroplating cells of the system. While each cell typically has its own electroplating bath in which electroplating is performed, in some embodiments, a reserve of electroplating bath fluid may be provided to each individual bath via fluidic connection to a common, shared reservoir. In some embodiments employing a shared reservoir, AGS-based pH adjustment procedures may actually take place within the shared reservoir itself, instead of within the individual plating cells. In certain such embodiments, this may eliminate the need for individual electroplating cells have their own dedicated AGSs, but more importantly, it may eliminate the need for individual electroplating cells to be taken offline (i.e., designated unavailable for electroplating) in order to have their pH levels brought within the desired range. Thus, in these sorts of configurations, instead of monitoring and adjusting pH levels within individual electroplating cells, the pH level of the shared bath reservoir may be monitored and continuously adjusted as need be without delaying electroplating operations in the individual cells, while at the same time pH levels within the individual cells are maintained within spec by virtue of their fluidic connection to the shared reservoir. However, it is also to be noted that incorporation and use of an electrolyte solution bath reservoir is not restricted to multi-cell electroplating system configurations—single cell configurations may employ bath reservoirs as well, as illustrated by bath reservoir 450 shown in FIGS. 4A and 4B. Moreover, depending on the embodiment, it may be feasible to locate an AGS inside bath reservoir 450 for many of the same reasons just described—such as, for example, that such placement may allow for the pH adjustment of the electrolyte solution in electroplating cell 410 without designating cell 410 unavailable for electroplating (as described above).

As indicated above, many configurations are possible for the AGS itself, in terms of size, shape, placement, orientation, and so forth. Obviously, it is not possible to provide a detailed description of all the possible configurations which are possible and consistent with the inventive concepts disclosed herein. Accordingly, as also indicated above, the embodiments now described with respect to FIGS. 3A, 3B, and 3C should be viewed as illustrative and not limiting of the inventive concepts within the scope of the instant disclosure. And, furthermore, it is noted that the AGS configurations described with respect to FIGS. 3A, 3B, and 3C may be implemented, in some cases, within an electroplating system having an oxygen removal device, as shown in FIGS. 4A and 4B.

Figure 5A:
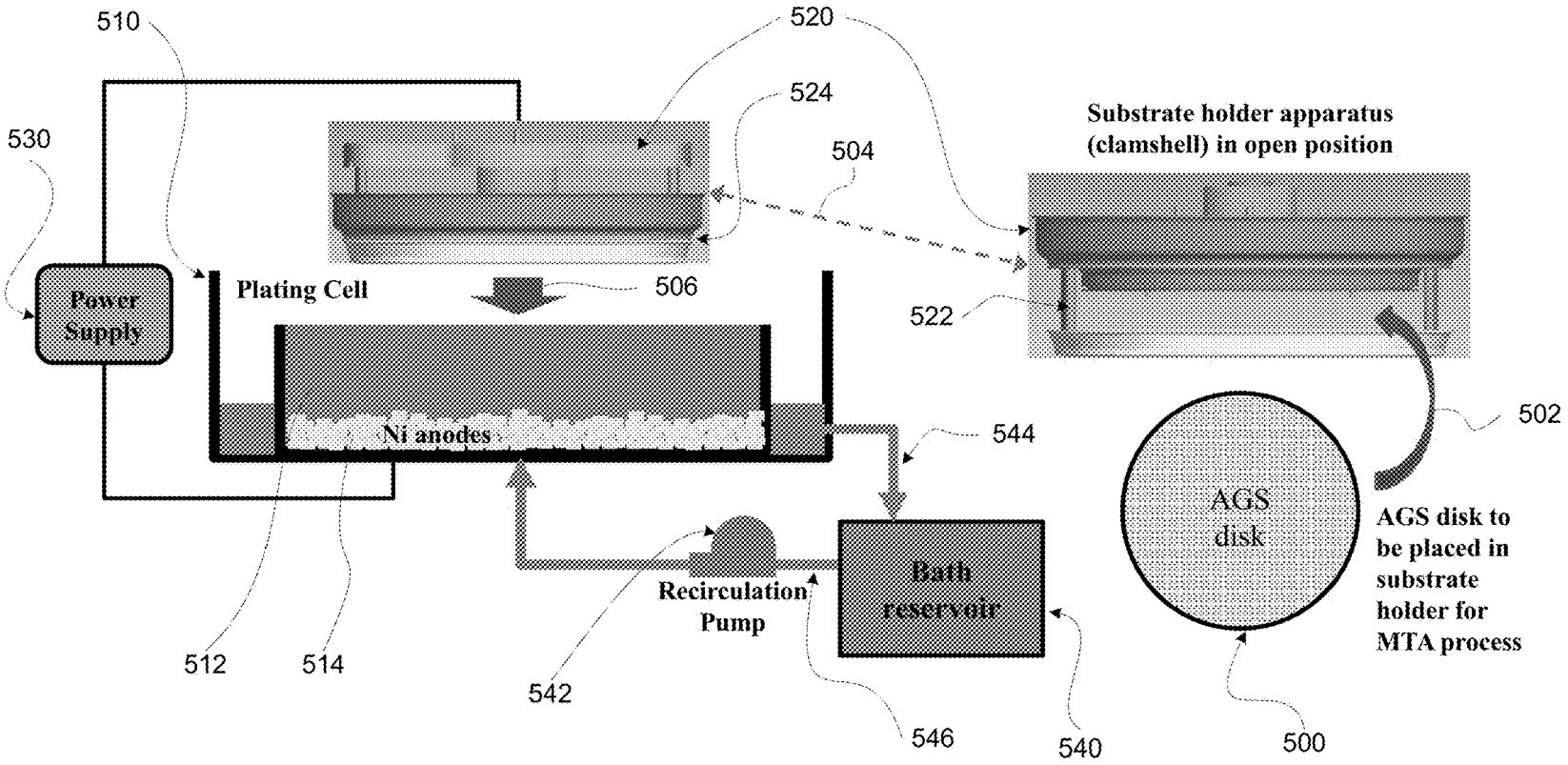
FIG. 5A schematically illustrates one embodiment of an acid generating surface (AGS) which is designed to have a disc-shaped configuration so that it may be inserted into an electroplating cell in place of a semiconductor substrate.

FIG. 5A schematically illustrates one embodiment of an acid generating surface (AGS) which is designed to have a disc-shaped configuration so that it may be inserted into the displayed electroplating cell 510 in place of a semiconductor substrate. In some embodiments, the disc comprises a body with a catalytic coating which, upon application of sufficient positive voltage to the disc, frees hydrogen ions from one or more components of the electroplating bath. In certain such embodiments, hydrogen ions are freed from water molecules through electrolysis at the surface of the catalytic coating. In some embodiments, the body of the disc may comprising an electrically-conductive, corrosion-resistant material which does not substantially corrode in an electroplating bath such as titanium, tantalum, niobium, or zirconium, for example. In some embodiments, the coating may comprise either platinum or one or more metal oxides selected from the oxides of iridium and tantalum. In some embodiments, the disc may have a diameter selected from about 100 mm, 200 mm, 250 mm, 300 mm, 350 mm, 400 mm, and about 450 mm. In some embodiments, a range of diameters may be suitable for the disc wherein the high and low ends of the possible ranges are selected from any combination of the foregoing recited diameters. In some embodiments, the disc may have a thickness selected from about 0.5 mm, 1 mm, 2 mm, 3 mm, 4 mm, and 5 mm. In some embodiments, a range of thicknesses may be suitable for the disc wherein the high and low ends of the possible ranges are selected from any combination of the foregoing recited diameters.

Also shown in FIG. 5A is the cup/cone clamshell assembly 520 into which the AGS disc 500 is to be inserted. In its open configuration 522, the clamshell assembly is ready to accept the AGS disc 500 as indicated by arrow 502 in the figure. After the AGS disc 500 is inserted, the clamshell is manipulated to its closed configuration 524 as indicated by dashed double arrow 504. After being closed, with the AGS disc 500 securely in place, the clamshell assembly 520 is lowered into the plating cell 510 and specifically into the electroplating bath 512 as indicated by arrow 506. At this point, the AGS is in position for execution of a metal-to-acid (MTA) process such as has been described above.

In this embodiment, nickel is the metal being electroplated—hence the nickel anode 514 illustrated in the figure—and so the overall effect of the MTA process will be to exchange $Ni^{2+}$ cations for $H^{+}$ ions as described in detail above. Furthermore, since in this embodiment, the nickel anode 514 serves as a counterelectrode to the AGS disc 500, the MTA process results in the plating of sold Ni back onto the nickel anode 514, the nickel anode 514 effectively functioning as a cathode. Thus, during the MTA process, the AGS disc 500 will be biased positive relative to the nickel anode 514 (which, again, serves as a cathodic counterelectrode to the AGS during MTA), which opposite to the bias that would be applied to a substrate held in the clamshell during electroplating. Accordingly, the power supply 530 shown in FIG. 5A has the capability of reversing polarity of the voltage difference it applies to the AGS disc and the nickel anode. In FIG. 5A, polarity reversal is schematically viewed as occurring within the power supply 530, however, it is to be understood that an external electrical switching mechanism could be used to provide this reversal of polarity.

Also shown in FIG. 5A are a bath reservoir 540 and recirculation pump 542, which collectively increase the volume of electroplating bath fluid available to the electroplating cell 510. Note, once again, as described above with respect to FIG. 2, a single bath reservoir may provide a reserve volume of electroplating bath fluid to multiple electroplating cells 510. In the embodiment displayed in FIG. 5A, despite the presence of the bath reservoir, AGS-based pH adjustment is performed in the plating cell 510 itself.

In some embodiments, the AGS disc 500 illustrated in FIG. 5A may be employed in an automated tool approach. For instance, the AGS disc 500 may be utilized in an MTA process for adjust the pH levels of the individual cells 309, 311, 313 of electroplating system 307 of FIG. 3D. Referring to FIG. 3D, in certain such embodiments, the AGS disc 500 may be handled and stored like a dummy substrate, and when a particular cell 309, 311, 313 is designated for pH correction—based upon the considerations described above—the AGS disc may be moved via back-end robot 325 to the particular cell designated for pH correction, and employed in an MTA process to adjust bath pH level in the designated cell.

An acid generating surface (AGS) may also be employed as a substantially integral part of an electroplating apparatus, or more specifically, substantially integrally affixed to some internal portion of an electroplating cell. For instance, an AGS may reside within each of the individual electroplating cells 309, 311, 313 of the electroplating apparatus displayed in FIG. 3D, and thus be in contact with the electroplating bath within each cell and capable of performing a pH adjustment. Accordingly, in general, an electroplating apparatus may be configured such that it includes an electroplating cell configured to contain an electroplating bath, a mount for holding a substrate in the electroplating bath, a substrate electrical contact configured to supply a voltage bias to the substrate while it is held in the mount, a counterelectrode electrical contact configured to supply a voltage bias to a counterelectrode while contacting the counterelectrode, an AGS configured to generate free hydrogen ions in the bath upon supply of sufficient positive voltage bias relative to the counterelectrode electrical contact, and one or more electrical power units configured to supply a negative voltage bias to the substrate electrical contact relative to the counterelectrode electrical contact—sufficient to reduce and plate metal ions from the bath onto the substrate surface—and to supply a positive voltage bias to the AGS relative to the counterelectrode electrical contact—sufficient to generate free hydrogen ions at the AGS.

Figure 5B:
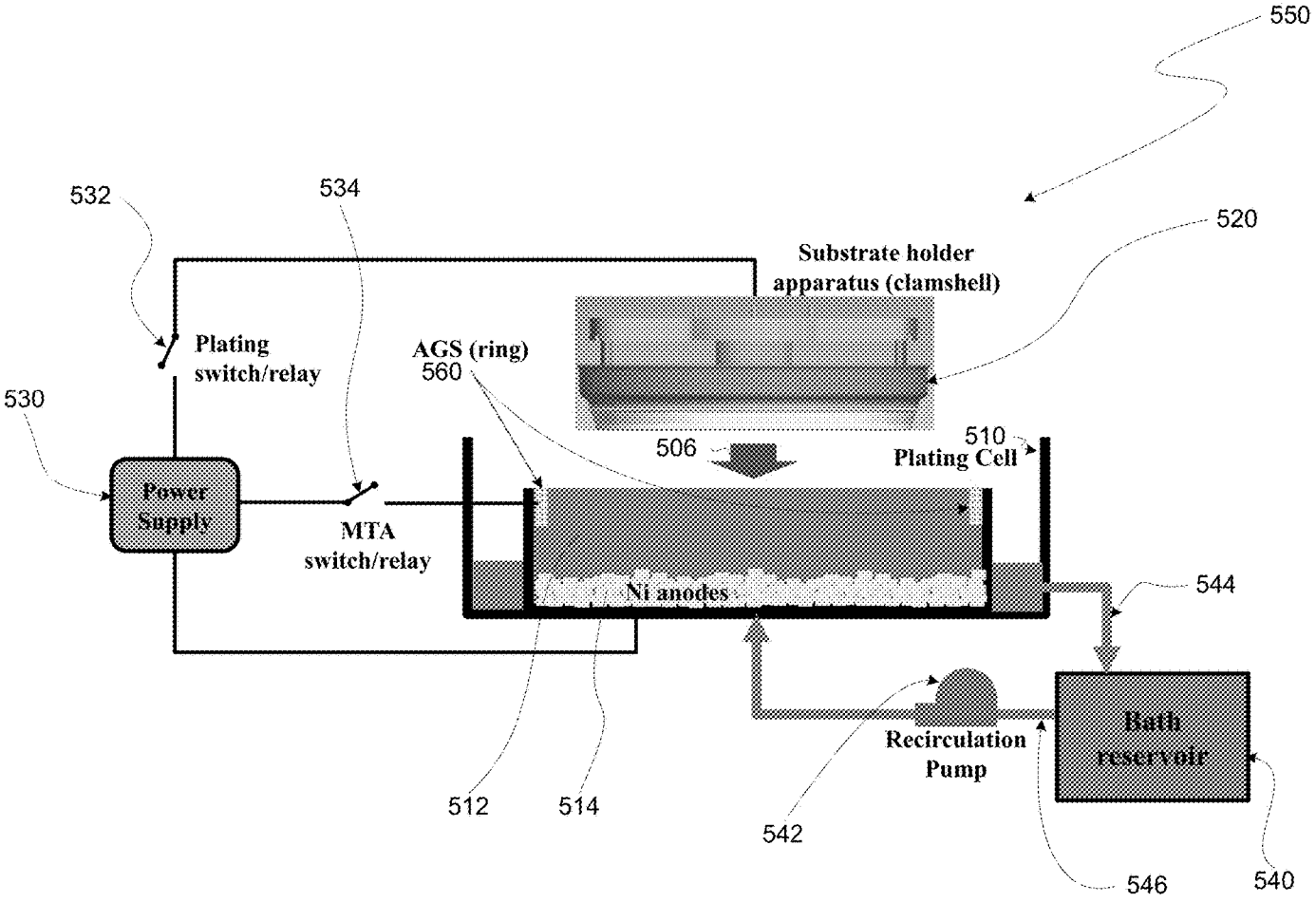
FIG. 5B schematically illustrates an electroplating apparatus having an integral AGS component in the form of an AGS ring attached to an interior wall of an electroplating cell.

FIG. 5B is a schematic representation of an electroplating apparatus 550 having an integral AGS component 560 for executing pH adjustment procedures. In the figure, the integral AGS component is in the form of an AGS ring 560 attached to an interior wall of the electroplating cell 510. One potential benefit of the ring-shaped AGS 550 exhibited in FIG. 5B is that by virtue of the AGS's radially outward placement in the electroplating cell 510, oxygen gas bubbles generated by this AGS tend to be dispersed radially away from the substrate location, thereby having a reduced likelihood of disturbing the substrate and potentially creating abnormalities on the substrate surface. Thus, in some embodiments, where dispersion of oxygen bubbles is sufficiently complete, the substrate may remain in the bath and separate from the cell during MTA operations. Some embodiments which have a ring-shaped AGS a shown in FIG. 5B may additionally include a membrane above the ring-shaped AGS 550. The membrane may function to further shield the substrate from oxygen bubbles generated at the AGS ring during the MTA process. Other components of the electroplating apparatus 550 exhibited in FIG. 5B include electroplating cell 510, clamshell assembly 520, power supply 550, bath reservoir 540, and pump 542. Bath reservoir 540 and recirculation pump 542 provide the same functionality as described above with respect to FIG. 5A.

To electroplate a substrate, the clamshell assembly 520 holding the substrate (which is not visible) is lowered (as shown by arrow 506) into the electroplating bath 512, and power supply 530 is used to apply a negative voltage bias to the substrate (via substrate electrical contacts not shown) relative to nickel anode 514 serving as a counterelectrode (via counterelectrode electrical contacts not shown). To perform an MTA pH adjustment procedure as described above, electroplating is concluded, the substrate is raised out of the bath, and a positive voltage bias—i.e. having polarity reversed from that used for electroplating—is applied to the AGS ring 550 relative to the nickel anode 514, causing acid to be generated at the AGS ring 550. In the ring AGS configuration exhibited in FIG. 5B, in addition to increasing bath $H^+$ concentration, execution of the MTA process causes excess $Ni^{2+}$ to be re-deposited back on the nickel anode 514, similar to what occurs with the AGS disc configuration illustrated in FIG. 5A.

In the embodiment shown in FIG. 5B, the positive (i.e., reversed) voltage bias is applied by the same electrical power unit/supply 530 which applied negative voltage bias to the substrate during electroplating. Thus, the electrical power unit/supply 530 exhibited in FIG. 5B functions as a dual-purpose electrical power unit configured to supply negative voltage bias to a substrate electrical contact relative to a counterelectrode electrical contact—in this case the nickel anode 514, and also a positive voltage bias to the AGS ring relative to the nickel anode 514. Furthermore, in some embodiments employing a dual-purpose electrical power unit, the electroplating apparatus may include one or more electrical relays controlling various electrical connections in order to effectuate the application of voltage biases of differing polarities to the AGS and substrate. Thus, in some embodiments, there may be a first relay controlling the electrical connection between the dual-purpose electrical power supply/unit and a substrate electrical contact, and a second relay controlling the electrical connection between the dual-purpose electrical power unit and the AGS. In certain such embodiments, during electroplating, the first relay is closed and the second relay is open so that a negative voltage bias relative to the counterelectrode electrical contact is supplied to the substrate electrical contact, and during the MTA process, the first relay is open and the second relay is closed so that a positive voltage bias relative to the counterelectrode electrical contact is supplied to the acid generating surface. This sort of configuration is schematically illustrated in FIG. 5B wherein the plating relay 532 acts as the aforementioned first relay, and the MTA relay 534 acts as the aforementioned second relay. Note that while use of a single dual-purpose electrical power unit has certain advantages (potentially low cost, compactness, etc.) configurations employing more than one electrical power supply/unit are also possible. For instance, an electroplating apparatus 550 may include a first electrical power unit configured to supply the negative voltage bias to the substrate electrical contact relative to the counterelectrode electrical contact, and a second electrical power unit configured to supply the positive voltage bias to the acid generating surface relative to the counterelectrode electrical contact. A set of electrical relays may also be used to control electrical connections and voltage bias application in a multiple power unit configuration, similar to the manner such relays are employed in FIG. 5B.

In some embodiments, a separate AGS (inert anode) and cathode (counterelectrode) in the bath, controlled by a computer via a monitored bath pH to decide when to turn on and for how long to correct the pH. The bath is in communication with the electrolyte in one of more cells. Bubbles are avoided from being introduced into the cell by allowing them to raise, and/or with a membrane (porous) diverted, around the electrode of the AGS system to prevent the bubbles from getting into the cell flow.

Thus, in some embodiments, an AGS may also be employed in a device having a volume of electroplating bath fluid which is distinct from the fluid volumes contained in the one or more electroplating cells upon which the device performs pH maintenance and/or adjustment. With such an AGS containing pH adjustment device, one or more fluidic connections between the device and the one or more electroplating cells allow exchange of bath fluid so that the hydrogen ions created in the device may be transferred to the one or more cells. Thus, for example, in some embodiments, such a device may be an acid generating bath reservoir (AGBR) which includes a container configured to hold a volume of electroplating bath fluid, a fluidic connector configured for establishing a fluidic connection between the container and an electroplating cell, an AGS and counterelectrode electrical contact disposed with the container, and one or more electrical power units configured to supply a positive voltage bias to the AGS relative to the counterelectrode electrical contact sufficient to generate free hydrogen ions. As with other implementations of AGSs disclosed herein, free hydrogen ions may be generated at the AGS by electrolysis of water molecules, in this case taking place in the volume of electroplating bath fluid within the AGBR. In some embodiments, the fluidic connector between the AGBR and an electroplating cell may include an inlet conduit configured to receive a flow (continuously or periodically) of electroplating bath fluid from the electroplating cell, an outlet conduit configured to send a flow of electroplating bath fluid to the electroplating cell, and a recirculation pump fluidically connected to the inlet and/or outlet conduits and configured to supply fluidic pressure within the inlet and/or outlet conduits. Since such an AGBR is designed to increase hydrogen ion concentration in the electroplating cell or cells to which it is connected, the pH of the electroplating bath fluid flowing within the outlet conduit is generally lower than the pH of the electroplating bath fluid flowing within the inlet conduit (if the AGS is or was turned on). Note that, in some embodiments, an AGBR may be a convenient way to place electrodes (AGS and/or cathodic counterelectrode) in fluidic communication with the electrolyte of an electroplating cell while keeping the bubbles or particles from the electrodes (AGS and/or cathode counterelectrode) from becoming problematic.

Figure 5C:
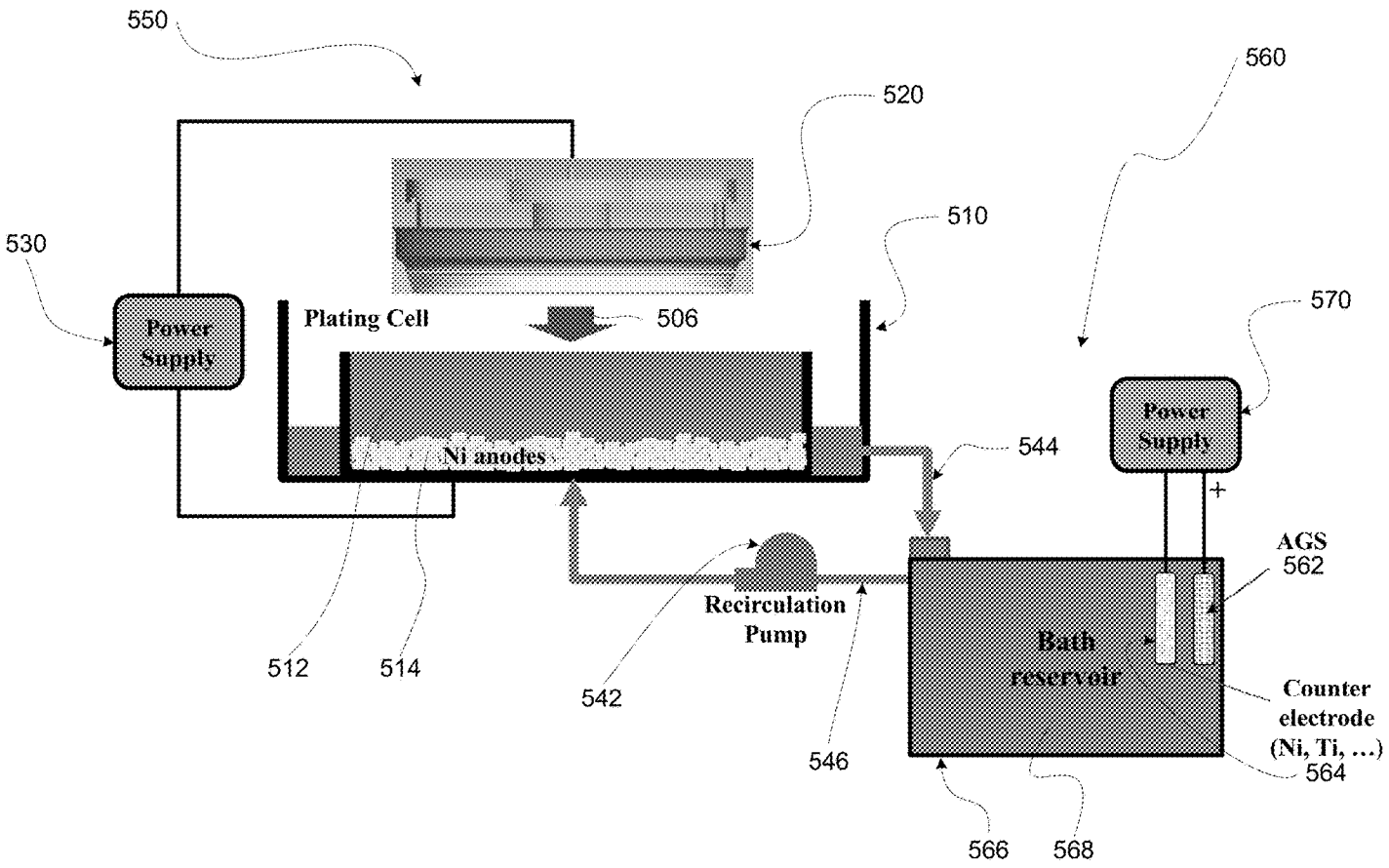
FIG. 5C schematically illustrates an acid generating bath reservoir which includes a container configured to hold a volume of electroplating bath fluid, and also an AGS and counterelectrode both disposed within the container and contacting the bath fluid.

FIG. 5C displays an AGBR device 560, and the schematic illustrates a number of the foregoing features. In the figure, the AGBR includes a container 566 configured to hold a volume of electroplating bath fluid 568, an AGS 562 and a counterelectrode 564 both disposed within the container and contacting the bath fluid, an electrical power/unit supply 570 configured to apply a positive bias voltage to the AGS 562 relative to the counterelectrode 564 in order to generate hydrogen ions within the bath fluid 568, recirculation pump 542, and fluidic connectors 544 and 546 connecting the AGBR device 560 to an electroplating cell 510. In some embodiments, the counterelectrode, which effectively functions as a cathode, may be comprised of nickel and/or titanium.

The electroplating cell 510 connected to AGBR device 560 in FIG. 5C and its associated components is similar to that schematically illustrated in FIG. 5B. Included in FIG. 5C are clamshell assembly 520, an electroplating bath 512 within the cell 510, a clamshell assembly 520 ready for lowering into the bath 512 (as indicated by arrow 506), a nickel anode 514 within the bath 512, and a power unit/supply 530 configured to supply a negative bias voltage to a substrate (not shown) within the clamshell assembly 520 relative to the nickel anodes 514. One key difference, however, is that the electroplating cell 510 of FIG. 5C does not itself contain an AGS in its interior. Instead pH levels are adjusted and maintained within the electroplating bath 512 through the fluidic connections 544 and 546 with the acid generating bath reservoir 560.

Although FIG. 5C displays an acid generating bath reservoir (AGBR) 560 which is physically separated and free-standing from the electroplating cell 510, in some embodiments, the two may be physically adjacent or attached to one another, as long as the volume of bath fluid contained in the AGBR is distinct from (albeit connected with) the volume contained in the cell 510. Moreover, in some embodiments, the AGBR may actually be located within the electroplating cell 510, once again, as long as the volume of bath fluid contained in the AGBR is distinct from the volume contained in the cell 510. In other embodiments, the AGBR may be placed within an electroplating fluid recirculation loop connected to the cell 510 similar to as shown in FIG. 5C. Accordingly, depending on the configuration, the AGBR may reasonably be viewed a component of an electroplating apparatus 550, whereas in other embodiments it may be viewed as a separate device.

Furthermore, in some embodiments, an AGBR may serve as a component in a multi-cell electroplating apparatus such as the automated electroplating apparatus 200 displayed in FIG. 2. As discussed above, the cells 207 of apparatus 200 may be fluidically connected to a shared electroplating bath reservoir (which is not shown in FIG. 2), and in some embodiments, this shared reservoir may contain an AGS and counterelectrode, such as those shown in FIG. 5C. As explained above, in certain such embodiments, the presence of an AGS and counterelectrode within the shared reservoir may eliminate the need for individual electroplating cells have their own dedicated AGSs. More importantly, it may eliminate the need for individual electroplating cells to forego electroplating operations while their pH levels are brought within the desired range. Accordingly, a shared reservoir which functions as an AGBR in a multi-cell electroplating apparatus may offer certain advantages.

Since an AGBR 560 has an AGS 562 and counterelectrode 564 residing in a volume of electroplating bath fluid 568 distinct from that of the electroplating cell 510 to which it is fluidically connected, an AGBR 560 oftentimes employs its own dedicated auxiliary electrical power supply/unit 570 distinct from the power supply 550 used for electroplating in the cell 510. In some embodiments, employing a dedicated power supply 570 allows an MTA process in the AGBR 560 to be run in parallel (contemporaneously) with an electroplating operation running in electroplating cell 510. However, in some embodiments, a dedicated auxiliary power supply is not necessarily required or even preferred.

For instance, in a multi-cell electroplating apparatus (such as 307 of FIG. 3D), if an additional power supply for the AGBR is not economically justifiable, one may be "borrowed" from an electroplating cell 309, 311, 313 which is not currently using its power supply to electroplate the workpiece. This "borrowing" may be accomplished through a system of relay switches capable of connecting a positive lead of the "borrowed" power supply to the AGBR's AGS, and a ground or negative lead of the "borrowed" power supply to the AGBR's counterelectrode. In some embodiments, the data processing system described above may be used to carry out the necessary scheduling required to "borrow" the power supply and to activate the appropriate electronic relays and/or switches.

Note, that unlike the AGS implementations discussed above with respect to FIGS. 5A and 5B, in the operation of AGBR 560, excess $Ni^{2+}$ cations present in the electroplating bath 512, while being removed from the bath via the MTA process, they are not re-deposited back onto nickel anode 514 in electroplating cell 510. Instead the $Ni^{2+}$ cations removed from bath 512 are deposited onto counterelectrode 564 within AGBR container 566. However, it is generally the case that the amount nickel which is not recollected onto anode 514 is relatively very small compared with the typical nickel anode's capacity.

Methods Employing Oxygen Concentration Reduction

Also disclosed herein are methods of electroplating metal onto a semiconductor substrate which reduce the oxygen concentration of at least some portion of the electrolyte solution used in the electroplating operation. In some embodiments, the metal being electroplated is nickel, and in some embodiments, the oxygen concentration in the electrolyte solution is reduced to about 1 PPM or less. In some embodiments, the oxygen concentration in the electrolyte solution is reduced to about 10 PPM or less, or more particularly reduced to about 5 PPM or less, or still more particularly, reduced to about 2 PPM or less, or yet still more particularly, reduced to about 0.5 PPM or less.

These methods may be performed in an electroplating cell such as those described above. Thus, in some embodiments, the electroplating cell may have an anode chamber containing a metal anode (e.g., a nickel anode), a cathode chamber, and a porous separator between the anode chamber and the cathode chamber. Porous separators are described above and, as such, they may be configured to permit passage of ionic current during electroplating but inhibiting the passage of electrolyte solution, at least to a certain extent.

Figure 6:
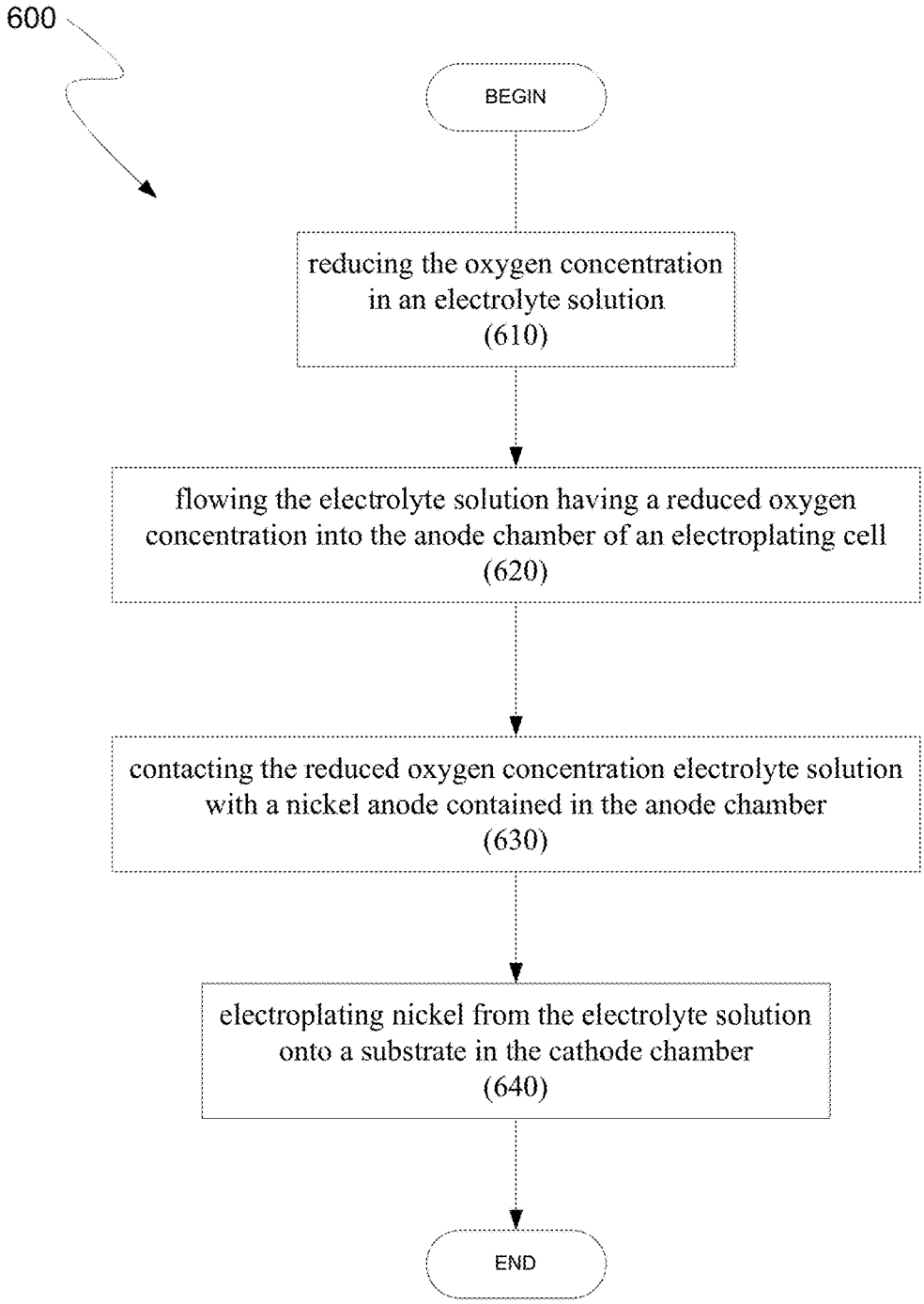
FIG. 6 schematically illustrates an electroplating method which includes reducing oxygen concentration in an electrolyte solution and flowing the electrolyte solution having a reduced oxygen concentration into the anode chamber of an electroplating cell.

Accordingly, in some embodiments such as illustrated in FIG. 6, an electroplating method 600 may include a reducing step 610 of reducing the oxygen concentration in an electrolyte solution, a flowing step 620 of flowing the electrolyte solution having a reduced oxygen concentration into the anode chamber of an electroplating cell, a contacting step 630 of contacting the reduced oxygen concentration electrolyte solution with a nickel anode contained in the anode chamber, and an electroplating step 640 of electroplating nickel from the electrolyte solution onto a substrate in the cathode chamber. In some embodiments, the electrolyte solution in the cathode chamber may be maintained at a pH within some predetermined range, such as between about pH 3.0 and 5.0, or more particularly, between about pH 3.5 and 4.5, or still more particularly, between about pH 3.8 and 4.2. In some cases, any two or more of steps 610, 620, 630, and 640 may be performed at the same time. In various embodiments, steps 610, 620, and 630 are performed concurrently while the electroplating systems is idle; that is while electroplating is not being performed. In some implementations, steps 610, 620, and 630 are performed continuously while electroplating step 640 is performed intermittently, whenever a substrate is present and in condition for electroplating. In this manner, the anolyte oxygen concentration remains low and the anolyte pH remains stable while the system idles between electroplating/substrate cycles.

Furthermore, in some embodiments, an electroplating method may further include flowing electrolyte solution to the cathode chamber having an oxygen concentration such that the oxygen concentration in the electrolyte solution flowed to the anode chamber is less than the oxygen concentration in the electrolyte solution flowed to the cathode chamber. FIG. 4B schematically illustrates an electroplating system 400 wherein, during operation, the concentration of electrolyte solution flowing to the anode and cathode chambers, 420, 430 respectively, may be as just described due to the fact that the oxygen removal device 480 is located in the anode chamber recirculation loop 425 but not in the cathode chamber recirculation loop 435, as described in detail above in reference to FIG. 4B.

The characteristics of the electrolyte solution used in the electroplating methods described herein may also be varied. For example, depending on the embodiment, an electrolyte solution may have an oxygen concentration of about 10 PPM or less, or about 5 PPM or less, or about 2 PPM or less, or about 1 PPM or less, or about 0.5 PPM or less, or about 0.2 PPM or less. pH range was also discussed above and, as discussed, an appropriate pH range may be between about pH 3.5 and 4.5, or between about pH 3.0 and 5.0, or between about pH 3.8 and 4.2. Likewise, depending on the embodiment, the temperature of the electrolyte solution during electroplating operations may be maintained above about 20 degrees Celsius, or above about 30 degrees Celsius, or above about 35 degrees Celsius, or above about 40 degrees Celsius, or above about 45 degrees Celsius, or above about 50 degrees Celsius, or above about 55 degrees Celsius. In particular, for nickel electroplating, the temperature of the electrolyte solution during electroplating operations may be maintained above about 35 degrees Celsius, or above about 40 degrees Celsius, or above about 45 degrees Celsius, or above about 50 degrees Celsius, or above about 55 degrees Celsius, or above about 60 degrees Celsius, or between about 30 and 60 degrees Celsius, or between about 35 and 55 degrees Celsius, or between about 40 and 50 degrees Celsius.

As far as electrolyte solution compositions, for nickel plating, several suitable nickel-sulfamate plating bath solutions may be used, such as, for example, those available from Enthone Inc., DOW Nikal BP, and Shitaya. Details are listed in the following table:

TABLE I

| OPERATING CONDITION/BATH | ENTHONE NI200 | | DOW NIKAL BP | | SHITAYA | |
|---|---|---|---|---|---|---|
| COMPONENT | Nominal | Range | Nominal | Range | Nominal | Range |
| Nickel | 75 g/L | 70 to 80 g/L | 90 g/L | 60 to 120 g/L | | |
| Nickel Sulfamate | 323 g/L | 260 to 390 g/L | 320 g/L | 210 to 430 g/L | 350 g/L | 250 to 450 g/L |
| Temperature | 55° C. | 50 to 60° C. | 57° C. | 50 to 62° C. | 47° C. | |
| pH | 4.0 | 3.5 to 4.5 | 4.0 | 3.5 to 4.5 | 4.0 | 3.5 to 4.5 |
| Boric Acid | 30 g/L | 25 to 40 g/L | 40 g/L | 38 to 56 g/L | 35 g/L | 30 to 40 g/L |
| Additive*/Wetting Agent** | 30 g/L* | | 10 ml/l** | 5 to 15 ml/l | | |
| Anode Activator | 63 ml/L | 48 to 85 mL/L | 15 ml/L | 10 to 20 ml/L | 6 g/L | 2 to 10 g/L |

Note that most commercial nickel plating solutions include an "anode activator" such as nickel chloride and/or bromide to promote uniform anode corrosion. "Brighteners" may also be used in nickel electroplating solutions, but in some embodiments, this is not necessary or even preferred. In some embodiments, such a brightener nickel additive may be added for the general purpose of grain refining. Saccharin is one such example that has been used in the past in nickel sulfamate baths. Many organic "additives" typically used in copper electroplating are generally not used in nickel electroplating. However, boric acid is typically present serving as a cathodic buffering agent, in concentrations less than about 45 g/L to avoid crystallization.

A variety of techniques and methods are available for reducing the oxygen concentration in the electrolyte solution flowing to the anode and/or cathode chambers. In some embodiments, reducing the oxygen concentration in the electrolyte solution may include degassing the electrolyte solution. In some embodiments, reducing the oxygen concentration in the electrolyte solution may include sparging the electrolyte solution with a gas substantially free of oxygen. The gas substantially free of oxygen may be an inert gas such as, for example, nitrogen and/or argon.

Some electroplating methods may include sending an message, or an alert, or a warning, etc. to the operator of an electroplating system—whether it be a human operator, automated system controller, etc.—if some process condition within an electroplating cell has strayed outside it's predetermined operating range. Thus, for instance, some electroplating methods may include steps of sensing the pH of the electrolyte solution in the electroplating cell and sending an alert if the sensed pH is more than about pH 4.5, or in some embodiments more than about 4.2, or in some embodiments more than about 5.0.

Likewise, some electroplating methods may include adjusting a process parameter, condition, etc. when it is determined that some process condition within an electroplating cell has strayed outside its predetermined operating range. Thus, for instance, some electroplating methods may include steps of sensing the pH of the electrolyte solution in the electroplating cell and further reducing the oxygen concentration in the electrolyte solution prior to flowing it into the anode chamber if the sensed pH is more than about 4.5, or in some embodiments more than about 4.2, or in some embodiments more than about 5.0. In another embodiment, an electroplating method may include steps of sensing the concentration of oxygen in the electrolyte solution in the anode chamber and further reducing the oxygen concentration in the electrolyte solution prior to flowing it into the anode chamber if the sensed oxygen concentration is more than about 1 PPM, or in some embodiments more than about 0.5 PPM, or in some embodiments more than about 2 PPM, or in some embodiments more than about 5 PPM, or in some embodiments more than about 10 PPM.

More generally, the techniques disclosed herein may be viewed as methods of preventing the pH of an electrolyte solution from increasing to more than a predetermined maximum pH level while electroplating a metal (such as nickel) from the electrolyte solution onto a semiconductor substrate in an electroplating cell having anode and cathode chambers. Such a method may include steps of reducing the oxygen concentration in the electrolyte solution to about or below a predetermined maximum oxygen concentration level prior to flowing the electrolyte solution into the anode chamber of the electroplating cell. Depending on the embodiment, an appropriate predetermined maximum pH level may be pH 5.0, or pH 4.5, or pH 4.2, and an appropriate predetermined maximum oxygen concentration level may be 10 PPM, or 5 PPM, or 2 PPM, or 1 PPM, or 0.5 PPM, or 0.2 PPM, or 0.1 PPM.

In various embodiments, a method of reducing the oxygen concentration in the anolyte is used in conjunction with a direct method of reducing the pH of the anolyte. Such direct methods include those employing an AGS (acid generating surface) as described with respect to FIGS. 5A-C. As an example, a method employing operations 610, 620, and 630 is performed continuously during normal wafer processing. Operation 640 is performed whenever a wafer is electroplated. Periodically, the method switches to a mode in which acid is generated from an acid generating surface as described above. When the pH returns to specification (or it is otherwise determined that the acid generating process has proceeded to a sufficient extent), the acid generating process may be stopped for a period of time.

Experimental

To illustrate the effect of oxygen removal on pH drift in an electroplating cell, pH measurements were made on an idle electrolyte bath solution left in contact with nickel anodes (i.e., in a no charge passed condition) over a period of 10 days. The results are shown in FIG. 6. As can be seen from the figure, without oxygen removal, the pH of the electrolyte solution increased from 3.8 to 4.5 in 7 days. The dissolved oxygen concentration of this electrolyte solution when it was flowed to the anode chamber was ~4.8 ppm.

Figure 7:
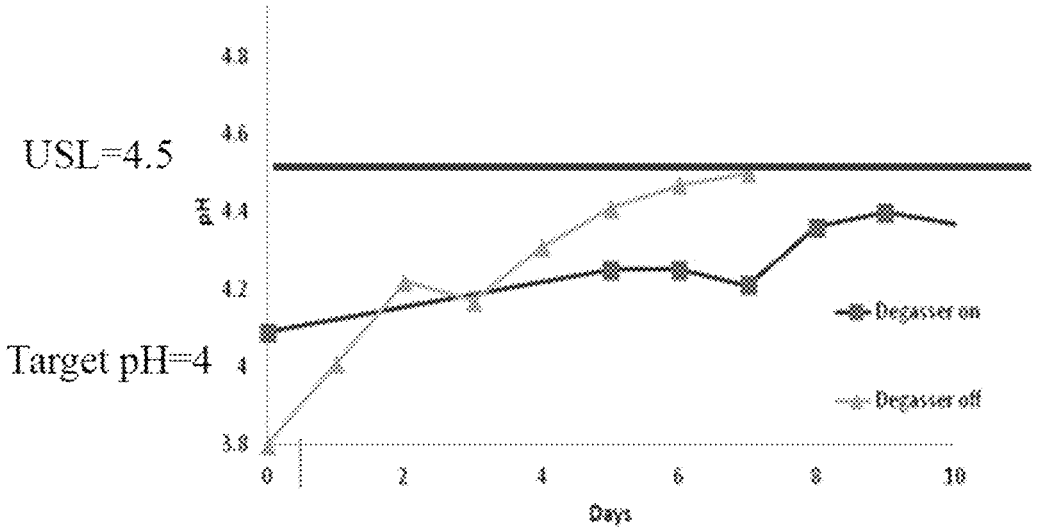
FIG. 7 displays a plot of pH level versus time and illustrates that oxygen removal significantly reduces the pH drift exhibited by idle nickel electroplating bath solutions.

In contrast, when oxygen removal was performed, the concentration of dissolved oxygen in the electrolyte solution flowed to the anode chamber was reduced to ~0.7 ppm. As shown in FIG. 7, the result was that the electrolyte solution exhibited only a very gradual rise in pH from pH 4.1 to pH 4.4 over the same 7 day period. Thus, as shown in FIG. 7, oxygen removal has been shown to significantly reduce the pH drift exhibited by idle nickel electroplating bath solutions.

Furthermore, it is anticipated that an additional reduction in the dissolved oxygen concentration of the anolyte solution flowed to the anode chamber would result in even less pH drift than shown in FIG. 7. Among other reasons, this is supported by the fact that the nitrogen purge experiment of FIG. 1C (~0.2 PPM dissolved oxygen) resulted in no change in pH over a 10 day period.

Other Embodiments

Although the foregoing processes, systems, apparatuses, and compositions have been described in some detail for the purpose of promoting clarity of understanding, it will be apparent to one of ordinary skill in the art that certain changes and modifications may be practiced within the scope of the appended claims. It should be noted that there are many alternative ways of implementing the processes, systems, apparatuses, and compositions disclosed herein. Accordingly, the disclosed embodiments are to be considered as illustrative and not restrictive, and the scope of each appended claims is not to be limited to the specific details of the embodiments described herein.

We claim:

1. An electroplating system for electroplating nickel onto a semiconductor substrate comprising:

an electroplating cell configured to hold an electrolyte solution during electroplating, the electroplating cell comprising:

(a) a cathode chamber;

(b) an anode chamber configured to hold a soluble nickel anode during electroplating;

(c) the soluble nickel anode positioned in the anode chamber, wherein the soluble nickel anode is configured to generate nickel ions during electroplating;

(d) a porous separator between the anode chamber and the cathode chamber permitting passage of ionic current during electroplating, but inhibiting the passage of electrolyte solution; and (e) a semiconductor substrate holder for holding the semiconductor substrate during electroplating; and an oxygen removal device arranged to reduce oxygen concentration in the electrolyte solution as it is flowed to the anode chamber during electroplating and during idle times when the system is not electroplating; and a pH meter configured to measure the pH of the electrolyte solution and logic for operating the oxygen removal device in response to values output by the pH meter.

2. The electroplating system of claim 1, wherein the porous separator is capable of maintaining a difference in oxygen concentration between the anode and cathode chambers.

3. The electroplating system of claim 1, further comprising an oxygen sensor configured to measure the concentration of oxygen in the electrolyte solution.

4. The electroplating system of claim 1, wherein the oxygen removal device comprises a degasser located in an anode chamber recirculation loop upstream from the anode chamber.

5. The electroplating system of claim 1, wherein the oxygen removal device is configured to reduce the oxygen concentration in the electrolyte solution flowing to the anode chamber during some or all idle times to a level such that the pH of the electrolyte solution does not appreciably increase when the electrolyte solution contacts the nickel anode during idle time.

6. An electroplating system for electroplating nickel onto a semiconductor substrate comprising:

an electroplating cell configured to hold an electrolyte solution during electroplating, the electroplating cell comprising:

(a) a cathode chamber;

(b) an anode chamber configured to hold a soluble nickel anode during electroplating;

(c) the soluble nickel anode positioned in the anode chamber, wherein the soluble nickel anode is configured to generate nickel ions during electroplating;

(d) a porous separator between the anode chamber and the cathode chamber permitting passage of ionic current during electroplating, but inhibiting the passage of electrolyte solution; and (e) a semiconductor substrate holder for holding the semiconductor substrate during electroplating;

an oxygen removal device arranged to reduce oxygen concentration in the electrolyte solution as it is flowed to the anode chamber during electroplating and during idle times when the system is not electroplating;

a semiconductor substrate electrical contact configured to supply a voltage bias to the semiconductor substrate while it is held in the semiconductor substrate holder;

a counterelectrode electrical contact configured to supply a voltage bias to a counterelectrode while contacting the counterelectrode;

an acid generating surface configured to generate free hydrogen ions in the electrolyte solution upon supply of sufficient positive voltage bias relative to the counterelectrode electrical contact; and one or more electrical power units configured to supply a negative voltage bias to the semiconductor substrate electrical contact relative to the counterelectrode electrical contact sufficient to reduce and plate nickel ions from the electrolyte solution onto the semiconductor substrate surface, and to supply a positive voltage bias to the acid generating surface relative to the counterelectrode electrical contact sufficient to generate free hydrogen ions at the acid generating surface thereby decreasing the pH of the electrolyte solution.

7. The electroplating system of claim 6, wherein the free hydrogen ions are generated at the acid generating surface by electrolysis of water molecules in the electrolyte solution.

8. The electroplating system of claim 6, wherein the acid generating surface comprises:

a body comprising an electrically conductive, corrosion-resistant material which does not substantially corrode in the electrolyte solution; and a coating on the body, the coating comprising either platinum or one or more metal oxides selected from the oxides of platinum, niobium, ruthenium, iridium, and tantalum.

9. The electroplating system of claim 8, wherein the electrically conductive, corrosion-resistant material is selected from the group consisting of titanium, tantalum, niobium, and zirconium.

10. The electroplating system of claim 6, further comprising:

an acid generating bath reservoir having a fluidic inlet and a fluidic outlet, the reservoir configured to hold a volume of the electrolyte solution, and within which the acid generating surface is located; and an acid generating bath reservoir recirculation loop fluidically coupling the acid generating bath reservoir's fluidic outlet with the anode chamber's fluidic inlet and/or cathode chamber's fluid inlet, and fluidically coupling the acid generating bath reservoir's fluidic inlet with the anode chamber's fluidic outlet and/or cathode chamber's fluidic outlet;

wherein the counterelectrode electrical contact is further configured to supply a voltage bias to a counterelectrode located within the acid generating bath reservoir; and wherein, during circulation of the electrolyte solution through the acid generating bath reservoir recirculation loop, the electrolyte solution flowing through the acid generating bath reservoir's fluidic outlet has a lower pH than the electrolyte solution flowing through the reservoir's fluidic inlet.

11. An electroplating system for electroplating nickel onto a semiconductor substrate comprising:

an electroplating cell configured to hold an electrolyte solution during electroplating, the electroplating cell comprising:

(a) a cathode chamber;

(b) an anode chamber configured to hold a nickel anode during electroplating;

(c) a porous separator between the anode chamber and the cathode chamber permitting passage of ionic current during electroplating, but inhibiting the passage of electrolyte solution; and (d) a semiconductor substrate holder for holding the semiconductor substrate during electroplating;

an oxygen removal device arranged to reduce oxygen concentration in the electrolyte solution as it is flowed to the anode chamber during electroplating and during idle times when the system is not electroplating;

an electrolyte recirculation system, wherein the electrolyte recirculation system is configured for mixing an electrolyte removed from the cathode chamber and an electrolyte removed from the anode chamber, and reintroducing the electrolyte after mixing to the electroplating cell, wherein the electrolyte recirculation system comprises an anode chamber recirculation loop and a cathode chamber recirculation loop, the loops having one or more shared fluid delivery lines, wherein the oxygen removal device comprises a degasser located in the anode chamber recirculation loop upstream from the anode chamber and downstream from a bath reservoir, and wherein the degasser is not located in the cathode chamber recirculation loop;

a semiconductor substrate electrical contact configured to supply a voltage bias to the semiconductor substrate while it is held in the semiconductor substrate holder;

a counterelectrode electrical contact configured to supply a voltage bias to a counterelectrode while contacting the counterelectrode;

an acid generating surface configured to generate free hydrogen ions in the electrolyte solution upon supply of sufficient positive voltage bias relative to the counter-electrode electrical contact; and one or more electrical power units configured to supply a negative voltage bias to the semiconductor substrate electrical contact relative to the counterelectrode electrical contact sufficient to reduce and plate nickel ions from the electrolyte solution onto the semiconductor substrate surface, and to supply a positive voltage bias to the acid generating surface relative to the counter-electrode electrical contact sufficient to generate free hydrogen ions at the acid generating surface thereby decreasing the pH of the electrolyte solution.

12. An electroplating system for electroplating nickel onto a semiconductor substrate comprising:

an electroplating cell configured to hold an electrolyte solution during electroplating, the electroplating cell comprising:

(a) a cathode chamber;

(b) an anode chamber configured to hold a nickel anode during electroplating;

(c) a porous separator between the anode chamber and the cathode chamber permitting passage of ionic current during electroplating, but inhibiting the passage of electrolyte solution; and (d) a semiconductor substrate holder for holding the semiconductor substrate during electroplating;

an oxygen removal device arranged to reduce oxygen concentration in the electrolyte solution as it is flowed to the anode chamber during electroplating and during idle times when the system is not electroplating; and an electrolyte recirculation system, wherein the electrolyte recirculation system is configured for mixing an electrolyte removed from the cathode chamber and an electrolyte removed from the anode chamber, and re-introducing the electrolyte after mixing to the electroplating cell, wherein the electrolyte recirculation system comprises an anode chamber recirculation loop and a cathode chamber recirculation loop, the loops having one or more shared fluid delivery lines, wherein the oxygen removal device comprises a degasser located in the anode chamber recirculation loop upstream from the anode chamber and downstream from a bath reservoir, wherein the degasser is not located in the cathode chamber recirculation loop, and wherein the anode chamber recirculation loop and the cathode chamber recirculation loop have at least one shared filter.

13. The electroplating system of claim 12, wherein the porous separator is capable of maintaining a difference in oxygen concentration between the anode and cathode chambers.

14. The electroplating system of claim 12, further comprising an oxygen sensor configured to measure the concentration of oxygen in the electrolyte solution.

15. The electroplating system of claim 12, further comprising a pH meter configured to measure pH of the electroplating solution.

16. The electroplating system of claim 12, wherein the oxygen removal device is configured to reduce the oxygen concentration in the electrolyte solution flowing to the anode chamber during some or all idle times to a level such that the pH of the electrolyte solution does not appreciably increase when the electrolyte solution contacts the nickel anode during idle time.

17. An electroplating system for electroplating nickel onto a semiconductor substrate comprising:

an electroplating cell configured to hold an electrolyte solution during electroplating, the electroplating cell comprising:

(a) a cathode chamber;

(b) an anode chamber configured to hold a nickel anode during electroplating;

(c) a porous separator between the anode chamber and the cathode chamber permitting passage of ionic current during electroplating, but inhibiting the passage of electrolyte solution; and (d) a semiconductor substrate holder for holding the semiconductor substrate during electroplating;

an oxygen removal device arranged to reduce oxygen concentration in the electrolyte solution as it is flowed to the anode chamber during electroplating and during idle times when the system is not electroplating; and an electrolyte recirculation system, wherein the electrolyte recirculation system is configured for mixing an electrolyte removed from the cathode chamber and an electrolyte removed from the anode chamber, and re-introducing the electrolyte after mixing to the electroplating cell, wherein the electrolyte recirculation system comprises an anode chamber recirculation loop and a cathode chamber recirculation loop, the loops having one or more shared fluid delivery lines, wherein the oxygen removal device comprises a degasser located in the anode chamber recirculation loop upstream from the anode chamber and downstream from a bath reservoir, wherein the degasser is not located in the cathode chamber recirculation loop, and wherein the anode chamber recirculation loop and the cathode chamber recirculation loop have at least one shared pump.

18. The electroplating system of claim 17, wherein the porous separator is capable of maintaining a difference in oxygen concentration between the anode and cathode chambers.

19. The electroplating system of claim 17, further comprising an oxygen sensor configured to measure the concentration of oxygen in the electrolyte solution.

20. The electroplating system of claim 17, further comprising a pH meter configured to measure pH of the electroplating solution.

21. The electroplating system of claim 17, wherein the oxygen removal device is configured to reduce the oxygen concentration in the electrolyte solution flowing to the anode chamber during some or all idle times to a level such that the pH of the electrolyte solution does not appreciably increase when the electrolyte solution contacts the nickel anode during idle time.

* * * * *